US008093161B2

(12) United States Patent
Bansal et al.

(10) Patent No.: US 8,093,161 B2
(45) **Date of Patent: *Jan. 10, 2012**

(54) STRETCHABLE NONWOVEN WEB AND METHOD THEREFOR

(75) Inventors: Vishal Bansal, Richmond, VA (US); Michael C. Davis, Midlothian, VA (US); Thomas Michael Ford, Greenville, DE (US); Debora Flanagan Massouda, Wilmington, DE (US); Edgar N. Rudisill, Nashville, TN (US); Harry Vaughn Samuelson, Chadds Ford, PA (US); Hyunkook Shin, Wilmington, DE (US); Gregory Paul Weeks, Hockessin, DE (US)

(73) Assignee: INVISTA North America S.àr.l., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/256,626

(22) Filed: Sep. 27, 2002

(65) Prior Publication Data

US 2003/0171052 A1 Sep. 11, 2003

Related U.S. Application Data

(60) Provisional application No. 60/325,624, filed on Sep. 28, 2001.

(51) Int. Cl.
*D04H 5/00* (2006.01)

(52) U.S. Cl. ..... 442/334; 442/335; 442/336; 442/337; 442/352

(58) Field of Classification Search ..... 428/397, 428/399, 362, 371, 377, 373; 442/329, 352, 442/353, 356, 359, 361, 364, 400–403, 407, 442/415, 334–337

See application file for complete search history.

(56) References Cited

U.S. PATENT DOCUMENTS

| | | | |
|---|---|---|---|
| 3,017,686 | A | 1/1962 | Breen at al. |
| 3,418,200 | A | 12/1968 | Tanner |
| 3,458,390 | A | 7/1969 | Ando et al. |
| 3,488,975 | A | 9/1969 | Duxbury et al. |
| 4,230,838 | A | 10/1980 | Foy et al. |
| 4,385,886 | A | 5/1983 | Samuelson |
| 4,405,686 | A | 9/1983 | Kuroda et al. |

(Continued)

FOREIGN PATENT DOCUMENTS

| | | | |
|---|---|---|---|
| EP | 0 430 227 | A | 6/1991 |

(Continued)

OTHER PUBLICATIONS

Jacob John and Mrinal Bhattacharya, Synthesis and properties of reactively compatibilized polyester and polyamide blends, Polymer International, 2000, pp. 860-866, 49-8.

*Primary Examiner* — Peter Y Choi
(74) *Attorney, Agent, or Firm* — Christina W. Geerlof

(57) ABSTRACT

The invention relates to nonwoven fabrics containing polymeric multiple component fibers which include a core component and a plurality of wing components attached to the core. The polymeric core component has an elasticity that is greater than the elasticity of at least one of the wing polymeric components. The fibers assume a spiral twist configuration in which the plurality of wings substantially spiral about the core. In a preferred embodiment, the nonwoven fabrics have elastic stretch and recovery properties with a textile-like hand.

42 Claims, 17 Drawing Sheets

U.S. PATENT DOCUMENTS

| | | | | | |
|---|---|---|---|---|---|
| 4,663,220 | A | | 5/1987 | Wisneski et al. | |
| 4,741,949 | A | | 5/1988 | Morman et al. | |
| 4,861,660 | A | | 8/1989 | Ishii | |
| 5,168,143 | A | | 12/1992 | Kobsa et al. | |
| 5,304,599 | A | | 4/1994 | Himes | |
| 5,332,613 | A | | 7/1994 | Taylor et al. | |
| 5,352,518 | A | | 10/1994 | Muramoto et al. | |
| 5,443,906 | A | * | 8/1995 | Pihl et al. | 428/370 |
| 5,780,156 | A | * | 7/1998 | Hoyt et al. | 428/373 |
| 5,997,989 | A | | 12/1999 | Gessner et al. | |
| 6,143,842 | A | | 11/2000 | Paton et al. | |
| 6,225,243 | B1 | | 5/2001 | Austin | |
| 6,352,948 | B1 | * | 3/2002 | Pike et al. | 442/384 |
| 2001/0038912 | A1 | * | 11/2001 | Billarant et al. | 428/364 |
| 2003/0077444 | A1 | * | 4/2003 | Bond et al. | 428/364 |

FOREIGN PATENT DOCUMENTS

| | | | |
|---|---|---|---|
| EP | 0 410379 | B | 4/1996 |
| WO | WO 00/28123 | A | 5/2000 |
| WO | WO 01/16232 | A | 3/2001 |

* cited by examiner

STRETCHABLE NONWOVEN WEB AND METHOD THEREFOR

BACKGROUND OF THE INVENTION

1. Field of the Invention

This invention relates to a stretchable nonwoven web containing multiple component fibers which comprise an elastomeric polymeric core and polymeric wings attached to the core wherein the wing polymer is either non-elastomeric or is less elastic than the core polymer. After suitable heat-treatment, the multiple component fibers form spiral twist and can also develop three-dimensional crimp.

2. Description of Related Art

Stretchable nonwoven fabrics are known in the art. For example U.S. Pat. No. 5,997,989 to Gessner et al. discloses a spunbond elastic nonwoven fabric comprising a web of bonded filaments of thermoplastic elastomer which is prepared in a slot draw spunbonding process operated at a rate of less than about 2000 meters per minute. Elastomeric meltblown webs are also known, for example meltblown webs of polyetherester polymers are described in U.S. Pat. No. 4,741,949 to Morman et al.

Nonwovens formed from elastomeric polymers generally have an undesirable rubber-like hand and therefore are often used in laminates wherein the elastomeric web is bonded on one or both sides to a non-elastomeric layer such as in a stretch-bonded or neck-bonded composite laminate. Nonwovens formed using a high content of elastomeric polymer are generally expensive because of the high cost of many elastomeric polymers. Layers of elastomeric webs also tend to adhere to one another, for example when wound on a roll, a phenomenon known in the art as "blocking".

Multiple component fibers comprising an elastomeric component and a non-elastomeric component are known in the art. For example, U.S. Pat. No. 4,861,660 to Ishii describes composite filaments suitable for preparing stretchable woven and knitted fabrics.

Nonwoven fabrics comprising laterally eccentric multiple component fibers comprising two or more synthetic components that differ in their ability to shrink are also known in the art. Such fibers develop three-dimensional helical crimp when the crimp is activated by subjecting the fibers to shrinking conditions in an essentially tensionless state. Helical crimp is distinguished from the two-dimensional crimp of mechanically crimped fibers such as stuffer-box crimped fibers. Helically crimped fibers generally stretch and recover in a spring-like fashion.

U.S. Pat. No. 4,405,686 to Kuroda et al. describes a highly stretchable conjugate filamentary yarn which is prepared from composite components respectively comprising a thermoplastic elastomer and non-elastomeric polyamide or polyester, each of the individual constituents having a cross-section of a compressed flat shape.

U.S. Pat. No. 6,225,243 to Austin describes a bonded web of multi-component strands that include a first polymeric component and a second polymeric component having an elasticity that is less than the first polymeric component.

There remains a need for elastic nonwoven fabrics having a high degree of recoverable elongation which also have improved hand and lower overall fabric cost than elastic nonwoven fabrics currently known in the art.

DETAILED DESCRIPTION OF THE INVENTION

Figures 1A, 1B:
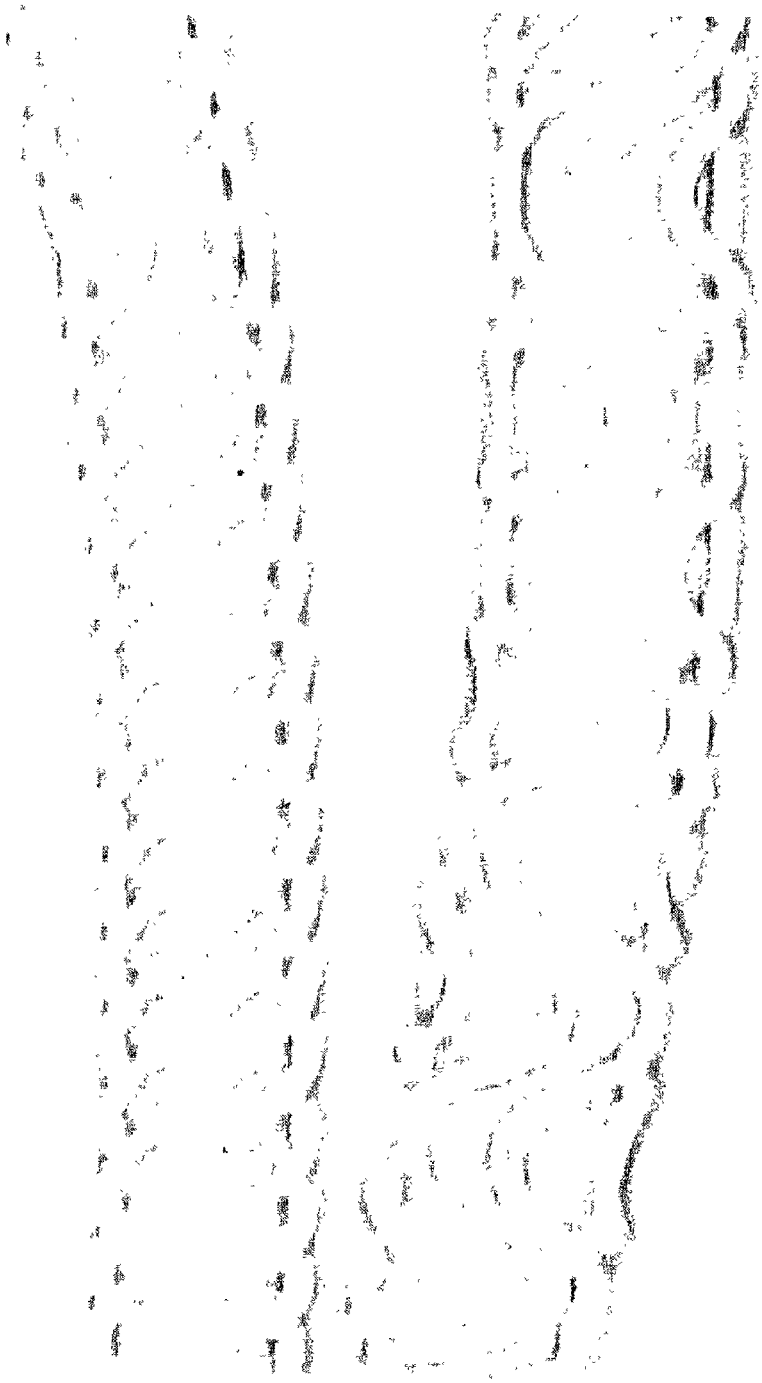
FIGS. 1A and 1B show fibers useful in forming the multiple component nonwoven fabrics of the current invention in which the spiral twist is substantially circumferential (1A) and in which the spiral twist is substantially non-circumferential (1B).

The present invention is directed toward multiple component nonwoven webs which have elastic stretch properties as well as a textile-like hand and lower cost compared to nonwovens made using fibers consisting essentially of elastomeric polymers. The nonwoven fabrics of the present invention can be used in a single layer while providing a textile-like hand without requiring lamination to other textile layers. The nonwoven fabrics can be fabricated to be sheerer and lighter weight than the multiple layer elastic fabrics of the prior art.

The nonwoven fabrics of the present invention comprise synthetic multiple component polymeric fibers that comprise a thermoplastic elastomeric axial core and a plurality of wings attached to the core. The polymeric core component has a greater elasticity than at least one of the polymeric wing components. The difference in elasticity between the core and wing polymeric components should be sufficient to cause the fibers to assume a substantially spiral twist configuration, as more fully described below. The spiral twist configuration can be developed after suitable heat treatment. In one embodiment, at least one of the wings comprises at least one permanently drawable, thermoplastic, non-elastomeric polymer. The stretch properties of the nonwoven fabric can be tailored by appropriate selection of the wing and core polymeric components. The bulkiness of the nonwoven fabrics of the present invention can also be adjusted by selecting fiber cross-sections of varying geometric and/or compositional symmetry. For example, low loft nonwoven fabrics are formed when the fibers have a substantially radially-symmetric cross-section. Fibers having asymmetric cross-sections generally form three-dimensional crimp, with the degree of crimp dependent on the degree of asymmetry in the fiber cross-section. Increasing levels of crimp result in nonwoven fabrics having increased bulk.

The term "polyolefin" as used herein, is intended to mean homopolymers, copolymers, and blends of polymers prepared from at least 50 weight percent of an unsaturated hydrocarbon monomer. Examples of polyolefins include polyethylene, polypropylene, poly(4-methylpentene-1) and copolymers made from various combinations of the ethylene, propylene, and methylpentene monomers, ethylene/alpha-olefin copolymers, ethylene/propylene hydrocarbon rubbers with and without diene cross-linking, ethylene vinyl acetate copolymers, ethylene methyl acrylate copolymers, ethylene methyl acrylate acrylic acid terpolymers, styrene/ethylene-butylene block copolymers, styrene-poly(ethylene-propylene)-styrene block copolymers, etc.

The term "polyethylene" (PE) as used herein is intended to encompass not only homopolymers of ethylene, but also copolymers wherein at least 85% of the recurring units are ethylene units.

The term "linear low density polyethylene" (LLDPE) as used herein refers to linear ethylene/α-olefin co-polymers having a density in the range of about 0.91 g/cm$^3$ to about 0.94 g/cm$^3$. The linear low density polyethylenes used in the present invention are prepared by co-polymerizing ethylene with an alpha,beta-ethylenically unsaturated alkene co-monomer (α-olefin), the α-olefin co-monomer having from 3 to 12 carbons per α-olefin molecule, and preferably from 4 to 8 carbons per α-olefin molecule. Alpha-olefins which can be co-polymerized with ethylene to produce LLDPE's useful in the present invention include propylene, 1-butene, 1-pentene, 1-hexene, 1-octene, 1-decene, or a mixture thereof. Preferably, the α-olefin is 1-hexene, 1-octene, or 1-butene. Linear low density polyethylenes useful in the present invention can be prepared using either Ziegler Natta or single site catalysts such as metallocene catalysts. Examples of suitable commercially available LLDPE's include those available from Dow Chemical Company, such as ASPUN Type 6811A (density 0.923 g/cm$^3$), Dow LLDPE 2500 (density 0.923 g/cm$^3$), Dow LLDPE Type 6808A (density 0.940 g/cm$^3$), Elite® 5000 LLDPE (density 0.92 g/cm$^3$) (Dow Chemical Co.) and the EXACT® and EXCEED™ series of LLDPE polymers from Exxon Chemical Company, such as Exact 2003 (density 0.921 g/cm$^3$) and Exceed 357C80 (density 0.917 g/cm$^3$). Ethylene/α-olefin copolymers made with single site catalysts and having densities less than about 0.91 g/cm$^3$ are generally elastomeric, and are referred to as plastomers.

The term "high density polyethylene" (HDPE) as used herein refers to a polyethylene homopolymer having a density of at least about 0.94 g/cm$^3$, and preferably in the range of about 0.94 g/cm$^3$ to about 0.965 g/cm$^3$ or higher.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. A common example of a polyester is poly(ethylene terephthalate) (PET) which is a condensation product of ethylene glycol and terephthalic acid.

As used herein, "thermoplastic" refers to a polymer that can be repeatedly melt-processed (for example melt-spun).

By "permanently drawable" is meant that the polymer has a yield point, and if the polymer is stretched beyond such point it will not return to its original length.

By "elastomeric polymer" is meant a polymer which in monocomponent fiber form, free of diluents, has a break elongation in excess of 100% and which when stretched to twice its length, held for five seconds, and then released, retracts to less than 1.5 times its original length within one minute of being released. The elastomeric polymers of the core in the multi-winged fibers used to form the nonwoven fabrics of this invention can have a flexural modulus of less than about 14,000 pounds per square inch (96,500 kPascals, more preferably less than about 8500 pounds per square inch (58,600 kPascals) when present in a monocomponent fiber spun under conditions substantially as described herein.

As used herein, "non-elastomeric polymer" means any polymer which is not an elastomeric polymer. Non-elastomeric polymers are also referred to herein as "hard" polymers.

The term "recover" as used herein refers to a retraction of a stretched material upon termination of a biasing force following stretching of the material by application of the biasing force. For example, if a material having a relaxed, unbiased length of one centimeter is elongated 60 percent by stretching to a length of 1.6 centimeters, the material would be elongated 60% (0.6 cm) and would have a stretched length that is 160 percent of its relaxed length. If this stretched material is allowed to contract upon removal of the biasing and stretching force, that is to recover, to a length of 1.2 centimeters, the material would have recovered about 67% (0.4 cm) of its 0.6 cm elongation. Recovery can be expressed as [(maximum stretched length−final sample length after removal of the stretching force)/(maximum stretched length−initial sample length)]×100.

The term "recoverable elongation" as used herein is a measure of how easily a sample is permanently deformed. The term "elastic nonwoven" as used herein refers to a nonwoven fabric or web which has greater than 50% recoverable elongation (less than 50% set) when stretched to elongations typical of use levels. A fabric can be elastic at low (use level) deformations but can be plastically deformed (or break) when stretched further. The force needed to achieve a given elongation during load/unload cycling is referred to herein as the "recovery power".

The term "nonwoven" fabric, sheet, or web as used herein means a textile structure of individual fibers, filaments, or threads that are directionally or randomly oriented and bonded by friction, and/or cohesion and/or adhesion, as opposed to a regular pattern of mechanically inter-engaged fibers, i.e., it is not a woven or knitted fabric. Examples of nonwoven fabrics and webs include spunbond continuous filament webs, carded webs, air-laid webs, and wet-laid webs. Suitable bonding methods include thermal bonding, chemical or solvent bonding, resin bonding, mechanical needling, hydraulic needling, stitchbonding, etc.

The term "spunbond" fibers as used herein means fibers which are formed by extruding molten thermoplastic polymer material as filaments from a plurality of fine capillaries of a spinneret with the diameter of the extruded filaments then being rapidly reduced by drawing and quenching the filaments. Spunbond fibers are generally continuous and have an average diameter of greater than about 5 micrometers. For fibers having a multi-winged cross-section used in the nonwoven fabrics of the current invention, the diameter of the fiber is calculated as the diameter of a circle having the same cross-sectional area as the multi-winged fiber. Spunbond nonwoven fabrics or webs are formed by laying spunbond fibers randomly on a collecting surface such as a screen or belt. Spunbond webs can be bonded by methods known in the art such as by hot-roll calendering or by passing the web through a saturated-steam chamber at an elevated pressure. For example, the web can be thermally point bonded at a plurality of thermal bond points located across the spunbond fabric.

The terms "multiple component fiber" and "multiple component filament" as used herein refer to any fiber or filament that is composed of at least two distinct polymers. The terms "bicomponent fiber" and "bicomponent filament" as used here in refer to a multiple component fiber or filament composed of two distinct polymers. By the term "distinct polymers" it is meant that each of the at least two polymers are arranged in distinct zones across the cross-section of the multiple component fibers and along the length of the fibers. Multiple component fibers are distinguished from fibers that are extruded from a homogeneous melt blend of polymeric materials in which no zones of distinct polymers are formed. The at least two distinct polymeric components useable herein can be chemically different or they can be chemically the same polymer, but having different physical characteristics, such as tacticity, intrinsic viscosity, melt viscosity, die swell, density, crystallinity, and melting point or softening point. For example, the two components can be an elastomeric polypropylene and a non-elastomeric polypropylene. Each of the at least two distinct polymeric components can themselves comprise a blend of two or more polymeric materials. The term "fiber" as used herein refers to both discontinuous and continuous fibers. The term "filament" as used herein refers to continuous fibers. The multi-winged fibers useful in the nonwoven fabrics of the current invention are multiple component fibers in which the core comprises one of the distinct polymeric components which is an elastomeric polymer and the wings attached to the core comprise at least one other distinct polymeric component which has an elasticity that is less than the elasticity of the elastomeric core polymer. For example, the polymeric wing components can comprise a permanently drawable hard polymer. The terms "multiple component nonwoven web" and "multiple component nonwoven fabric" may be used herein to refer to a nonwoven web or fabric, respectively, comprising multiple component fibers or filaments. The term "bicomponent web" as used herein refers to a multiple component web which comprises bicomponent fibers or filaments.

The term "single component" fibers as used herein refers to fibers made from a single polymeric component. The single polymeric component can consist essentially of a single polymer or can be a homogeneous blend of polymers.

As used herein, the term "serpentine rolls" means a series of two or more rolls which are arranged with respect to each other such that the fibers are directed under and over sequential rolls with a single wrap on each roll and in which alternating rolls are rotating in opposite directions.

In a preferred embodiment, the multiple component nonwoven webs of the present invention comprise multiple component fibers comprising an axial core component of a synthetic thermoplastic elastomeric polymer and a plurality of wing components comprising at least one permanently drawable, non-elastomeric thermoplastic polymer attached to the core. The term "wing" as used herein refers to a protuberance from the central axial core of a fiber which extends substantially along the length of the fiber. A wing is distinguished from circumferential ridges formed in sheath core-fibers such as those described in U.S. Pat. No. 5,352,518 to Muramoto et al.

The fibers used to form the nonwoven fabrics of the present invention can have either a radially symmetric or a radially asymmetric cross-section. By "radially symmetric" cross-section is meant a cross-section in which the wings are located and are of dimensions such that rotation of the fiber about its longitudinal axis by 360°/n, in which "n" is an integer greater than 1 representing the "n-fold" symmetry of the fibers, results in substantially the same cross-section as before rotation. In determining the symmetry of a fiber, a cross-section is taken perpendicular to the fiber axis. Symmetry is established in the fibers as they are spun, and can be measured in the cross-section of a fully extended fiber after shrinkage if the fibers have not been distorted by processes subsequent to spinning. In determining symmetry of crimped fibers, the fibers should be mounted such that any crimp is pulled out to straighten the fibers prior to cross-sectioning the fiber.

In addition to possessing radial symmetry in terms of geometry, "radially symmetric" also means that the fiber cross-section is substantially symmetric in terms of polymeric composition. That is, after rotation of the fiber about its longitudinal axis by 360°/n where n is an integer greater than 1, the fiber itself is substantially indistinguishable from the fiber before rotation in terms of the composition of the wings. Some wings can be formed from a different polymer from the other wings of the fiber, once again provided substantially radial geometric and polymer composition symmetry is maintained. However, for simplicity of manufacture and ease of attaining radial symmetry, when fibers having substantially no three-dimensional crimp are desired, it is preferred that the wings be of approximately the same dimensions, and be made of the same polymer or blend of polymers. A fiber cross-section that is not radially symmetric is referred to herein as radially asymmetric and requires rotation by 360 degrees in order to duplicate the fiber cross-section in terms of geometry and composition.

The term "spiral twist" is used herein to refer to twist in which a fiber is twisted around its longitudinal axis. Multiple component fibers comprising an elastomeric core and a plurality of non-elastomeric permanently drawable wings attached to the core which have a substantially radially symmetric cross-section form substantially "one-dimensional"

spiral twist after an appropriate heat treatment. "One dimensional" spiral twist as used herein means that while the wings of the fiber can be substantially spiral about the fiber axis, the axis of the fiber is substantially straight even at low tension, with no substantial development of three-dimensional crimp. Very low levels of crimp can develop in radially symmetric fibers due to slight non-uniformities which can occur during or after spinning. Fibers that require less than about 10% stretch (calculated based on the unstretched fiber length) to substantially straighten the fiber core are considered as having one-dimensional spiral twist. These fibers more typically require less than about 7% stretch, for example, about 4% to about 6% stretch. Fibers that require greater than 10% stretch calculated based on the unstretched length, are considered to have higher dimensional crimp and are not considered to have substantially one-dimensional spiral twist. It has been observed that a fully 360° spiral twist is not necessary to achieve the desirable stretch properties in the fiber. As such, spiral twist can include i) spiral twist wherein the wings spiral substantially completely around the elastomeric core (substantially circumferential spiral twist) and ii) spiral twist wherein the wings spiral only partly around the core (substantially non-circumferential spiral twist). In fibers having substantially circumferential spiral twist, the wings spiral in one direction along the length of the fiber without reversing direction until the wings have spiraled about the fiber core by at least 360 degrees, i.e. the wings have spiraled completely around the circumference of the fiber core at least once before reversing direction. In fibers having substantially circumferential spiral twist, the direction of the twist can reverse at one or more reversal nodes along the length of the fiber. For example, there can be a plurality of reversal nodes along the length of the fiber with the direction of spiral twist reversing at each node. In fibers having substantally non-circumferential spiral twist, the wings spiral only partly (i.e. less than 360 degrees) around the core with frequent reversals in the direction the wings spiral around the core. Fibers can have various combinations of circumferential and non-circumferential twist as depicted in FIGS. 1A and 1B, respectively. When fibers comprising an elastomeric core and a plurality of non-elastomeric permanently drawable wings attached thereto have a radially asymmetric cross-section in terms of geometry and/or composition and are subjected to an appropriate heat treatment, the fibers develop both spiral twist and higher-dimensional crimp. For example, the fibers can develop three-dimensional crimp, such as three-dimensional helical crimp wherein the fiber axis forms a spiral-like configuration, or other more random three-dimensional crimp.

When tension is applied to the spirally twisted elastomeric asymmetric fibers, the three-dimensional crimp is pulled out first as the fibers straighten to ultimately provide tensioned fibers having substantially one-dimensional spiral twist when the fiber axis is substantially straight. When additional tension is applied, the elastomeric core stretches and the pitch of the spirals increases as the wings "untwist" to ultimately straighten the wing components so that they extend substantially longitudinally along the fiber length. The degree of three-dimensional crimp developed is dependent on the degree of compositional and/or geometric asymmetry of the fiber cross-section.

Core Polymers

The core polymer used in the multiple component fibers can be formed from any fiber-forming thermoplastic elastomeric polymer composition. Examples of useful elastomers include thermoplastic polyurethane, polyester, polyolefin, and polyamide elastomers. A blend of two or more elastomeric polymers or a blend of at least one elastomeric polymer with one or more hard polymers can be used as the core polymer. If a blend of an elastomeric polymer with a hard polymer is used, the hard polymer should be added at sufficiently low amounts so that the polymer blend retains elastomeric properties as defined above.

Useful thermoplastic polyurethane core elastomers include those prepared from a polymeric glycol, a diisocyanate, and at least one diol or diamine chain extender. Diol chain extenders are preferred because the polyurethanes made therewith have lower melting points than if a diamine chain extender were used. Polymeric glycols useful in the preparation of the elastomeric polyurethanes include polyether glycols, polyester glycols, polycarbonate glycols and copolymers thereof. Examples of such glycols include poly (ethyleneether) glycol, poly(tetramethyleneether) glycol, poly(tetramethylene-co-2-methyl-tetramethyleneether) glycol, poly(ethylene-co-1,4-butylene adipate) glycol, poly(ethylene-co-1,2-propylene adipate) glycol, poly(hexamethylene-co-2,2-dimethyl-1,3-propylene adipate), poly(3-methyl-1,5-pentylene adipate) glycol, poly(3-methyl-1,5-pentylene nonanoate) glycol, poly(2,2-dimethyl-1,3-propylene dodecanoate) glycol, poly(pentane-1,5-carbonate) glycol, and poly(hexane-1,6-carbonate) glycol. Useful diisocyanates include 1-isocyanato-4-[(4-isocyanatophenyl)methyl]benzene, 1-isocyanato-2-[(4-isocyanato-phenyl)methyl]benzene, isophorone diisocyanate, 1,6-hexanediisocyanate, 2,2-bis(4-isocyanatophenyl)propane, 1,4-bis(p-isocyanato, alpha,alpha-dimethylbenzyl)benzene, 1,1'-methylenebis(4-isocyanatocyclohexane), and 2,4-tolylene diisocyanate. Useful diol chain extenders include ethylene glycol, 1,3-trimethylene glycol, 1,4-butanediol, 2,2-dimethyl-1,3-propylene diol, diethylene glycol, and mixtures thereof. Preferred polymeric glycols are poly(tetramethyleneether) glycol, poly (tetramethylene-co-2-methyl-tetramethyleneether) glycol, poly(ethylene-co-1,4-butylene adipate) glycol, and poly(2,2-dimethyl-1,3-propylene dodecanoate) glycol. 1-Isocyanato-4-[(4-isocyanatophenyl)methyl]benzene is a preferred diisocyanate. Preferred diol chain extenders are 1,3-trimethylene glycol and 1,4-butanediol. Monofunctional chain terminators such as 1-butanol and the like can be added to control the molecular weight of the polymer. Polyurethane elastomers include Pellethane® thermoplastic polyurethanes available from Dow Chemical Company, which is a preferred core polymer.

Useful thermoplastic polyester elastomers include the polyetheresters made by the reaction of a polyether glycol with a low-molecular weight diol, for example, a molecular weight of less than about 250, and a dicarboxylic acid or diester thereof. Useful polyether glycols include poly(ethyleneether) glycol, poly(tetramethyleneether) glycol, poly(tetramethylene-co-2-methyltetramethyleneether) glycol [derived from the copolymerization of tetrahydrofuran and 3-methyltetrahydrofuran] and poly(ethylene-co-tetramethyleneether) glycol. Useful low-molecular weight diols include ethylene glycol, 1,3-trimethylene glycol, 1,4-butanediol, 2,2-dimethyl-1,3-propylene diol, and mixtures thereof; 1,3-trimethylene glycol and 1,4-butanediol are preferred. Useful dicarboxylic acids include terephthalic acid, optionally with minor amounts of isophthalic acid, and diesters thereof (e.g., <20 mol %). A preferred example of commercially available polyester elastomers includes Hytrel® polyetheresters available from E. I. du Pont de Nemours and Company, Wilmington, Del. (DuPont). Hytrel® elastomers are block co-polymers of hard (crystalline) segments of poly(1,4-butylene terephthalate) and soft (amorphous) segments based on long-chain polyether glycols such as poly(tetramethyleneether) glycols.

Useful thermoplastic polyesteramide elastomers that can be used in making the core of the fibers of the invention include those described in U.S. Pat. No. 3,468,975, herein incorporated by reference. For example, such elastomers can be prepared with polyester segments made by the reaction of ethylene glycol, 1,2-propanediol, 1,3-propanediol, 1,4-butanediol, 2,2-dimethyl-1,3-propanediol, 1,5-pentanediol, 1,6-hexanediol, 1,10-decandiol, 1,4-di(methylol)cyclohexane, diethylene glycol, or triethylene glycol with malonic acid, succinic acid, glutaric acid, adipic acid, 2-methyladipic acid, 3-methyladipic acid, 3,4-dimethyladipic acid, pimelic acid, suberic acid, azelaic acid, sebacic acid, or dodecandioic acid, or esters thereof. Examples of polyamide segments in such polyesteramides include those prepared by the reaction of hexamethylene diamine or dodecamethylene diamine with terephthalic acid, oxalic acid, adipic acid, or sebacic acid, and by the ring-opening polymerization of caprolactam.

Thermoplastic polyetheresteramide elastomers, such as those described in U.S. Pat. No. 4,230,838, herein incorporated by reference, can also be used to make the fiber core. Such elastomers can be prepared, for example, by preparing a dicarboxylic acid-terminated polyamide prepolymer from a low molecular weight (for example, about 300 to about 15,000) polycaprolactam, polyoenantholactam, polydodecanolactam, polyundecanolactam, poly(11-aminoundecanoic acid), poly(12-aminododecanoic acid), poly(hexamethylene adipate), poly(hexamethylene azelate), poly (hexamethylene sebacate), poly(hexamethylene undecanoate), poly(hexamethylene dodecanoate), poly(nonamethylene adipate), or the like and succinic acid, adipic acid, suberic acid, azelaic acid, sebacic acid, undecanedioic acid, terephthalic acid, dodecanedioic acid, or the like. The prepolymer can then be reacted with an hydroxy-terminated polyether, for example poly(tetramethylene ether) glycol, poly(tetramethylene-co-2-methyltetramethylene ether) glycol, poly(propylene ether) glycol, poly(ethylene ether) glycol, or the like. Examples of commercially available polyetheresteramide elastomers include Pebax® polyetheresteramides available from Atofina (Philadelphia, Pa.).

Examples of suitable polyolefin elastomers include polypropylene-based copolymers or terpolymers and polyethylene-based copolymers or terpolymers. A preferred class of elastomeric polyolefins are copolymers of ethylene/1-octene available commercially as Engage® polymers from Dow Chemical Company. Engage® polymers generally contain between about 15 to about 25 mole percent 1-octene. Other olefin-based elastomers include those commercially available as the Exact® resins from ExxonMobil and the Affinity® resins from Dow Chemical Company, having densities less than about 0.91 g/cm$^3$. These are all co-polymers of ethylene with 1-octene, 1-hexene, or 1-butene, made with single site catalysts, and are generally referred to as plastomers. Elastic properties generally increase and density generally decreases as the alpha-olefin co-monomer level is increased. Affinity® plastomers available from Dow Chemical company contain between about 3 and about 15 mole percent 1-octene. Elastomeric polyolefins, including elastomeric polypropylenes, can be formed according to the method described in U.S. Pat. No. 6,143,842 to Paton et al., which is hereby incorporated by reference.

Other suitable polyolefin elastomers include ethylene/propylene hydrocarbon rubbers with and without diene cross-linking, such as Nordel® elastomers available from DuPont Dow Elastomers (Wilmington, Del.).

Elastomeric polyolefins disclosed in European Patent Application Publication 0416379 published Mar. 13, 1991, which is hereby incorporated by reference, can also be used as the elastomeric core component. These polymers are heterophasic block copolymers which include a crystalline base polymer fraction and an amorphous copolymer fraction having elastic properties which is blocked thereon via semi-crystalline homo- or copolymer fraction. In a preferred embodiment, the thermoplastic, primarily crystalline olefin polymer is comprised of at least about 60 to 85 parts of the crystalline polymer fraction, at least about 1 to less than 15 parts of the semi-crystalline polymer fraction and at least about 10 to less than 39 parts of the amorphous polymer fraction. More preferably, the primarily crystalline olefin block copolymer comprises 65 to 75 parts of the crystalline copolymer fraction, from 3 to less than 15 parts of the semi-crystalline polymer fraction and from 10 to less than 30 parts of the amorphous copolymer fraction.

Suitable polyolefin elastomers include those in which the crystalline base polymer block of the heterophasic copolymer is a copolymer of propylene and at least one alpha-olefin having the formula $H_2C{=}CHR$, where R is H or a $C_{2-6}$ straight or branched chain alkyl moiety. Preferably the amorphous copolymer block with elastic properties of the heterophasic copolymer comprises an alpha-olefin and propylene with or without a diene or a different alpha-olefin terpolymer and the semi-crystalline copolymer block is a low density, essentially linear copolymer consisting substantially of units of the alpha-olefin used to prepare the amorphous block or the alpha-olefin used to prepare the amorphous block present in the greatest amount where two alpha-olefins are used.

Other elastomeric polymers suitable for use in the current invention include high pressure ethylene copolymers. Examples include ethylene vinyl acetate copolymers (e.g. ELVAX® polymers available from DuPont), ethylene methyl acrylate copolymers (e.g. Optema® polymers available from ExxonMobil), ethylene-methyl acrylate-acrylic acid terpolymers (e.g. Escor® polymers available from ExxonMobil), and ethylene acrylic acid and ethylene methacrylic acid copolymers (e.g. Nucrel® polymers available from DuPont).

Other thermoplastic elastomers suitable for use as the elastomeric core polymer include styrenic block copolymers having the general formula A-B-A' or A-B, where A and A' are each a polymer end block which contains a styrenic moiety such as a poly(vinyl arene) and B is an elastomeric polymer midblock such as a conjugated diene or a lower alkene polymer. Block copolymers of the A-B-A' type can have different or the same block polymers for the A and A' blocks. Examples of such block copolymers include copoly(styrene/ethylene-butylene), styrene-poly(ethylene-propylene)-styrene, styrene-poly(ethylene-butylene)-styrene, poly(styrene/ethylene-butylene/styrene) and the like. Commercial examples of such block copolymers are Kraton® block copolymers which are available from Kraton Polymers (formerly available from Shell Chemical Company of Houston, Tex.). Examples of such block copolymers are described in U.S. Pat. Nos. 4,663,220 and 5,304,599, hereby incorporated by reference.

Polymers composed of an elastomeric A-B-A-B tetrablock copolymer can also be used as the axial core polymer. Such polymers are discussed in U.S. Pat. No. 5,332,613 to Taylor et al., which is hereby incorporated by reference. In such polymers, A is a thermoplastic polymer block and B is an isoprene monomer unit hydrogenated to a substantially poly(ethylene-propylene) monomer unit. An example of such a tetrablock copolymer is a styrene-poly(ethylene-propylene)-styrene-poly(ethylene-propylene) or SEPSEP elastomeric block copolymer, available from Kraton Polymers (formerly available from Shell Chemical Company of Houston Tex.) under the trade designation Kraton® G-1659.

Wing Polymers

The polymeric wing components of the multiple component fibers can be formed from non-elastomeric or elastomeric polymers. If the polymeric wing components are elastomeric, they are selected to have an elasticity less than that of the polymeric core component so that the fibers develop the desired spiral twist configuration substantially along the length of the fibers. For example, the polymeric core component can be selected to be an elastomeric polymer having a flexural modulus less than 8500 lb/in$^2$ (58,600 kPa) and the polymeric wing component can have a flexural modulus of at least 8500 lb/in$^2$. Further, the polymeric wing component can have a flexural modulus between 8500 lb/in$^2$ and 14,000 lb/in$^2$ (58,600 kPa and 96,500 kPa). Preferably, the wing polymer is substantially less elastic than the core polymer, for example the core polymer can be an elastomeric polymer having a flexural modulus less than 8500 lb/in$^2$ (58,600 kPa) and the wing polymer can be selected to have a flexural modulus between about 12,000 lb/in$^2$ and 14,000 lb/in$^2$ (82,700 kPa to 96,500 kPa). For example, the polymeric wing component can comprise an Affinity® polyolefin plastomer and the polymeric core component can comprise a Hytrel® elastomeric polyester or an Engage® elastomeric polyolefin.

The wings can also be formed from any thermoplastic non-elastomeric (hard) permanently drawable polymer. Examples of such polymers include non-elastomeric polyesters, polyamides, and polyolefins.

Useful thermoplastic non-elastomeric wing polyesters include poly(ethylene terephthalate) (2GT), poly(trimethylene terephthalate) (3GT), polybutylene terephthalate (4GT), and poly(ethylene 2,6-naphthalate), poly(1,4-cyclohexylenedimethylene terephthalate), poly(lactide), poly(ethylene azelate), poly[ethylene-2,7-naphthalate], poly(glycolic acid), poly(ethylene succinate), poly(.alpha.,.alpha.-dimethylpropiolactone), poly(para-hydroxybenzoate), poly(ethylene oxybenzoate), poly(ethylene isophthalate), poly(tetramethylene terephthalate, poly(hexamethylene terephthalate), poly (decamethylene terephthalate), poly(1,4-cyclohexane dimethylene terephthalate) (trans), poly(ethylene 1,5-naphthalate), poly(ethylene 2,6-naphthalate), poly(1,4-cyclohexylidene dimethylene terephthalate)(cis), and poly(1,4-cyclohexylidene dimethylene terephthalate)(trans).

Preferred non-elastomeric polyesters include poly(ethylene terephthalate), poly(trimethylene terephthalate), and poly(1,4-butylene terephthalate) and copolymers thereof. When a relatively high-melting polyester such as poly(ethylene terephthalate) is used, a comonomer can be incorporated into the polyester so that it can be spun at reduced temperatures. Such polymers are referred to herein generally as copolyesters. Suitable comonomers include linear, cyclic, and branched aliphatic dicarboxylic acids having 4-12 carbon atoms (for example pentanedioic acid); aromatic dicarboxylic acids other than terephthalic acid and having 8-12 carbon atoms (for example isophthalic acid); linear, cyclic, and branched aliphatic diols having 3-8 carbon atoms (for example 1,3-propane diol, 1,2-propanediol, 1,4-butanediol, and 2,2-dimethyl-1,3-propanediol); and aliphatic and araliphatic ether glycols having 4-10 carbon atoms (for example hydroquinone bis(2-hydroxyethyl) ether). The comonomer can be present in the copolyester at a level in the range of about 0.5 to 15 mole percent. Isophthalic acid, pentanedioic acid, hexanedioic acid, 1,3-propane diol, and 1,4-butanediol are preferred comonomers for poly(ethylene terephthalate) because they are readily commercially available and inexpensive.

The wing polyester(s) can also contain minor amounts of other comonomers, provided such comonomers do not have an adverse affect on fiber properties. Such other comonomers include 5-sodium-sulfoisophthalate, for example, at a level in the range of about 0.2 to 5 mole percent. Very small amounts, for example, about 0.1 wt % to about 0.5 wt % based on total ingredients, of trifunctional comonomers, for example trimellitic acid, can be incorporated for viscosity control.

Useful thermoplastic non-elastomeric wing polyamides include poly(hexamethylene adipamide) (nylon 6,6); polycaprolactam (nylon 6); polyenanthamide (nylon 7); nylon 10; poly(12-dodecanolactam) (nylon 12); polytetramethyleneadipamide (nylon 4,6); polyhexamethylene sebacamide (nylon 6,10); the polyamide of n-dodecanedioic acid and hexamethylenediamine (nylon 6,12); the polyamide of dodecamethylenediamine and n-dodecanedioic acid (nylon 12,12), PACM-12 polyamide derived from bis(4-aminocyclohexyl)methane and dodecanedioic acid, the copolyamide of 30% hexamethylene diammonium isophthalate and 70% hexamethylene diammonium adipate, the copolyamide of up to 30% bis-(p-amidocyclohexyl)methylene, and terephthalic acid and caprolactam, poly(4-aminobutyric acid) (nylon 4), poly(8-aminooctanoic acid) (nylon 8), poly(hepta-methylene pimelamide) (nylon 7,7), poly(octamethylene suberamide) (nylon 8,8), poly(nonamethylene azelamide) (nylon 9,9), poly(decamethylene azelamide) (nylon 10,9), poly(decamethylene sebacamide (nylon 10,10), poly[bis(4-amino-cyclohexyl)methane-1,10-decanedicarboxamide], poly(m-xylene adipamide), poly(p-xylene sebacamide), poly(2,2,2-trimethylhexamethylene pimelamide), poly(piperazine sebacamide), poly(11-amino-undecanoic acid) (nylon 11), polyhexamethylene isophthalamide, polyhexamethylene terephthalamide, and poly(9-aminononanoic acid) (nylon 9) polycaproamide. Copolyamides can also be used, for example poly(hexamethylene-co-2-methylpentamethylene adipamide) in which the hexamethylene moiety can be present at about 75-90 mol % of total diamine-derived moieties.

Useful polyolefins include polypropylene, polyethylene, polymethylpentane and copolymers and terpolymers of one or more of ethylene or propylene with other unsaturated monomers, and blends thereof.

Combinations of elastomeric core and non-elastomeric wing polymers can include a polyetheramide, for example, a polyetheresteramide, elastomer core with polyamide wings and a polyetherester elastomer core with polyester wings. For example a wing polymer can comprise nylon 6-6, and copolymers thereof, for example, poly(hexamethylene-co-2-methylpentamethylene adipamide) in which the hexamethylene moiety is present at about 80 mole % optionally mixed with about 1% up to about 15% by weight of nylon-12, and a core polymer can comprise an elastomeric segmented polyetheresteramide. "Segmented polyetheresteramide" means a polymer having soft segments (long-chain polyether) covalently bound (by the ester groups) to hard segments (short-chain polyamides). Similar definitions correspond to segmented polyetherester, segmented polyurethane, and the like. The nylon 12 can improve the wing adhesion to the core, especially when the core is based on nylon 12, such as, PEBAX® 3533SN polyether block polyamide elastomer, supplied by Atofina Chemicals (Philadelphia, Pa.).

Another preferred wing polymer can comprise a non-elastomeric polyester selected from the group of poly(ethylene terephthalate) and copolymers thereof, poly(trimethylene terephthalate), and poly(tetramethylene terephthalate). An elastomeric core suitable for use therewith can comprise a polyetherester comprising the reaction product of a polyether glycol selected from the group of poly(tetramethyleneether) glycol and poly(tetramethylene-co-2-methyl-tetramethyleneether) glycol with terephthalic acid or dimethyl terephthalate and a low molecular weight diol selected from the group of 1,3-propane diol and 1,4-butane diol.

An elastomeric polyetherester core can also be used with non-elastomeric polyamide wings, especially when an adhesion-promoting additive is used, as described elsewhere herein. For example, the wings of such a fiber can be selected from the group of (a) poly(hexamethylene adipamide) and copolymers thereof with 2-methylpentamethylene diamine and (b) polycaprolactam, and the core of such a fiber can be selected from the group of the reaction products of poly (tetramethyleneether) glycol or poly(tetramethylene-co-2-methyltetramethyleneether) glycol with terphthalic acid or dimethyl terephthalate and a diol selected from the group of 1,3-propane diol and 1,4-butene diol.

Methods of making the polymers described above are known in the art and can include the use of catalysts, co-catalysts, and chain-branchers, as known in the art. The polymers used in spinning the multi-winged multiple component fibers can comprise conventional additives, which can be added either during the polymerization process or to the formed polymer or nonwoven article and can contribute towards improving the polymer or fiber properties. Examples of these additives include antistatic agents, antioxidants, antimicrobials, flameproofing agents, dyestuffs, light stabilizers, polymerization catalysts and auxiliaries, adhesion promoters, delustrants such as titanium dioxide, matting agents, and organic phosphates.

The nonwoven webs of the present invention include continuous filament webs and discontinuous staple fiber webs which comprise multiple component stretchable synthetic fibers having a multi-winged cross-section in which an elastomeric polymer forms the core and one or more permanently drawable hard polymers form a plurality of wings attached to the elastomeric core and extending along the length thereof. Alternately, the wing components can comprise an elastomeric polymer having a lower degree of elasticity than the core polymer. The wings can become intermittently detached along the length of some of the fibers during fiber or nonwoven processing. It is not necessary that the wings be continuously attached along the length of the fibers so long as the fibers are not prevented from developing the desired spiral twist configuration along a substantial portion of the length of the fibers. For example, the nonwoven web can be a continuous filament web formed in a spunbonding process. Alternately, the nonwoven web can be either a carded staple web prepared using a carding or garnetting machine or an airlaid web prepared by discharging staple fibers into an air stream which guides the fibers to a collecting surface on which the fibers settle. The nonwoven web can be a wetlaid web prepared by dispersing the fiber in water at very high dilution. In a wetlay process, the dispersion is fed to a box where the water is drained through a moving screen upon which the fibers are deposited. The nonwoven webs can comprise fibers of different deniers, and the ratios of the elastomeric core polymer to non-elastomeric wing polymer(s) can differ from fiber to fiber.

The nonwoven webs can also comprise blends of the multi-winged multiple component fibers with other secondary or "companion fibers". Examples of suitable companion fibers include single component fibers of polyesters or polyolefins, such as, poly(ethylene terephthalate) or polypropylene. When the nonwoven web comprises a blend of the multi-winged fibers which have latent spiral twist (i.e. which shrink and develop spiral twist upon appropriate heat treatment) with companion fibers that have a lesser degree of shrinkage than the multi-winged fibers during heat treatment, the nonwoven web is a "self-bulking" web. When the latent spiral twist is activated, the multi-winged fibers shrink causing the companion fibers to bend as they are engaged by the spiral segments, thus increasing the bulk of the nonwoven web.

The wings of the multiple component fibers protrude outward from the core to which they adhere and spirally coil at least part way around the core especially after effective heat treatment (relaxation). Heat treatment to develop the spiral twist can be conducted before or after forming the nonwoven web. The multi-winged multiple component fibers have at least 2 wings, and preferably 3-8 wings, and most preferably 5 or 6 wings. The number of wings used can depend on other features of the fiber and the conditions under which it will be made and used. At higher wing numbers, for example 5 or greater, the wing spacing can be frequent enough around the core that the elastomer can be protected from contact with rolls, guides, and the like during fiber or nonwoven manufacture. This reduces the likelihood of fiber breaks, roll wraps, and wear opposed to if fewer wings were used. Higher draw ratios and fiber tensions tend to press the fiber harder against rolls and guides, thus splaying out the wings and bringing the elastomeric core into contact with the roll or guide; hence the preference for a higher number of wings at high draw ratios and fiber tensions, especially when the elastomer is the low-melting polymeric component in the multiple component fibers. When a multifiber yarn is desired, such as in spinning of yarns used in preparing staple fibers, as few as two or three wings can be used because the likelihood of contact between the elastomeric core and rolls or guides is reduced by the presence of the other fibers. Fewer wings can be preferred in thermally bonded nonwoven webs wherein bonding is achieved through the elastomeric core polymer. The number of wings can be selected to provide the optimum balance of ease of processing and thermal bonding.

Co-pending non-provisional application Ser. Nos. 09/966,145 and 09/966,037, both filed Sep. 28, 2001 describe stretchable fibers comprising an axial core formed from an elastomeric polymer and a plurality of wings formed from a non-elastomeric polymer attached to the elastomeric core useful in knitted and woven fabrics. These applications are incorporated herein by reference.

Figure 2:
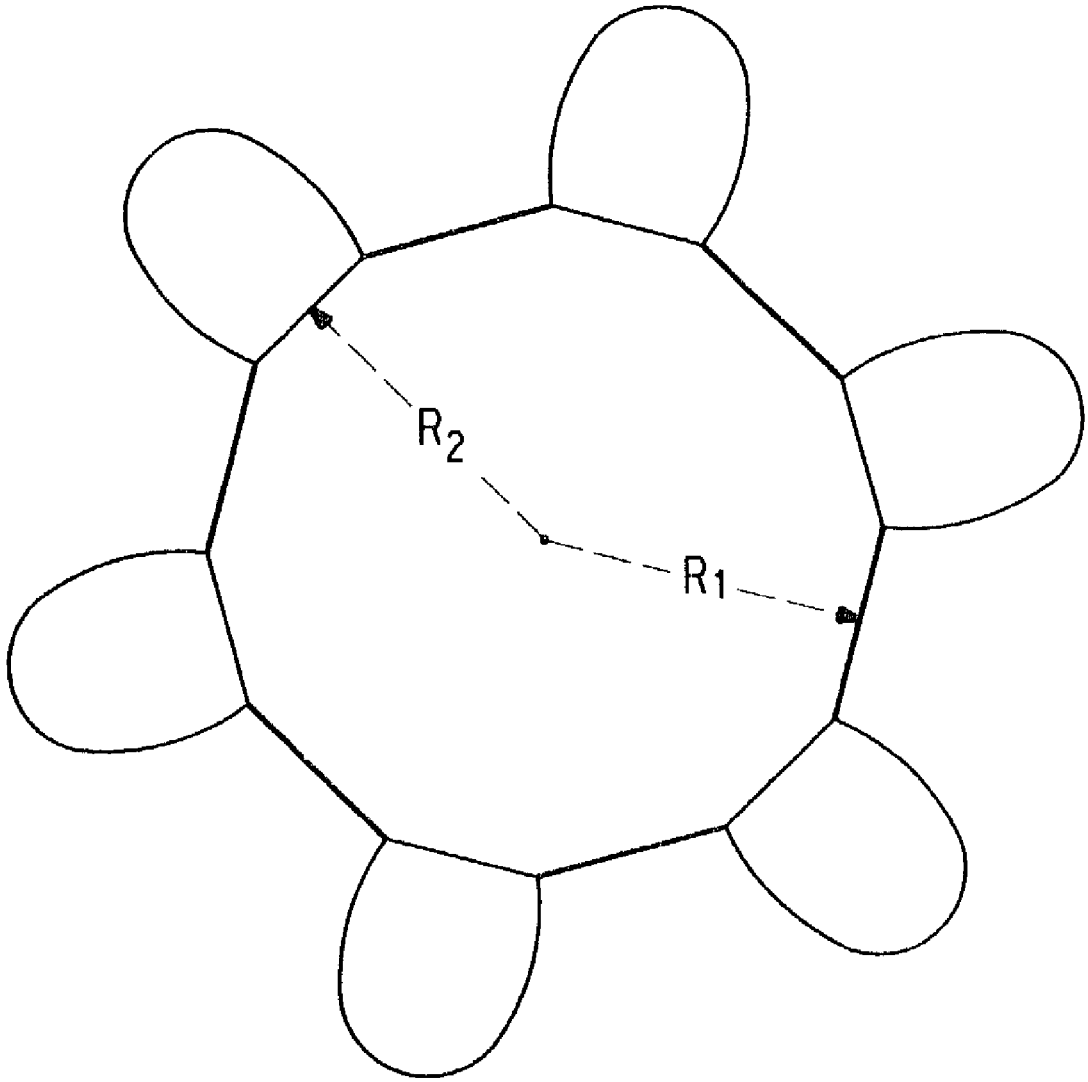
FIG. 2 shows a schematic cross-section of a six-winged multiple component fiber in which the wings are symmetrically arranged about a regular dodecahedral elastomeric core.
Figure 3:
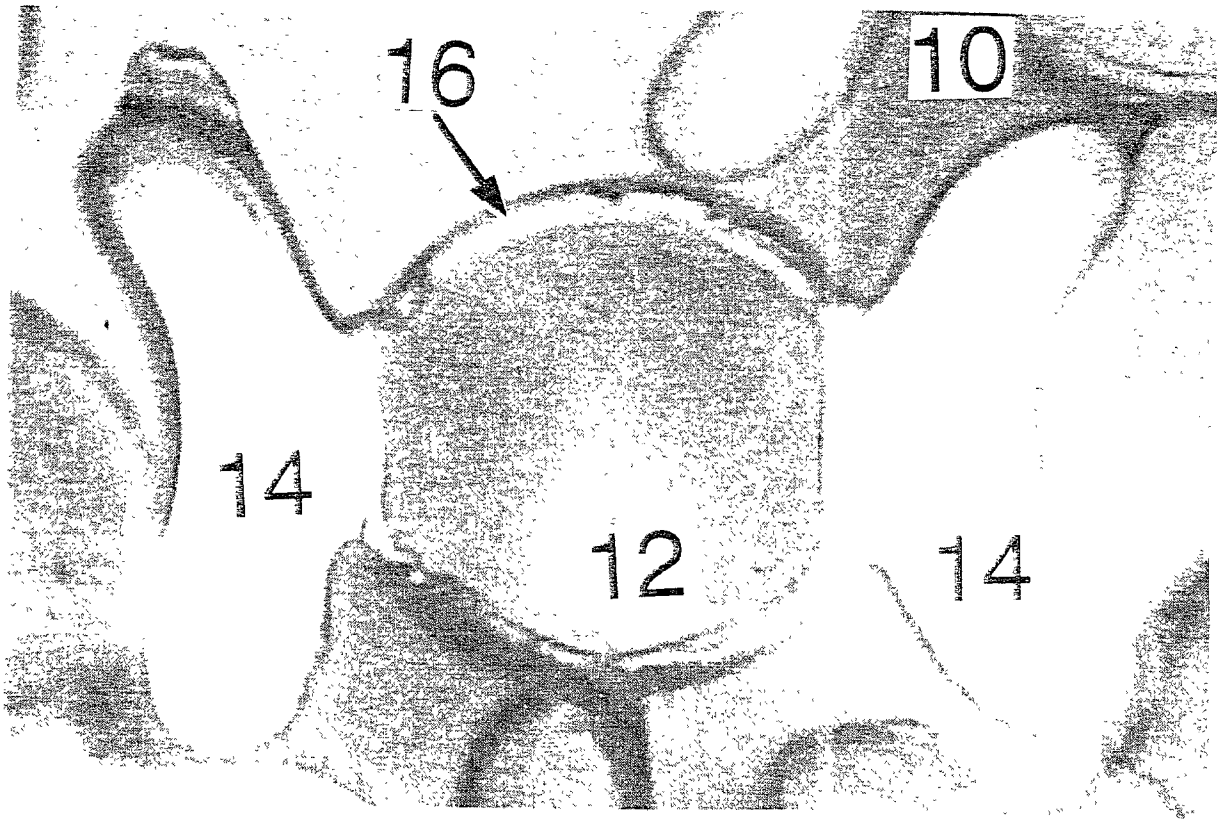
FIG. 3 is a photomicrographic cross-section of a particular symmetrical two-winged fiber having a thin sheath around the core and between the wings.

FIG. 2 is a schematic cross-section of a fiber useful in the nonwoven fabrics of the invention showing six wings symmetrically arranged and surrounding an axial core. It should be noted in FIGS. 3-7 and 15 that the fiber is designated generally as 10, the axial core as 12 and the wings as 14. While it is preferred that the wings discontinuously surround the core for ease of manufacture, the wing polymer can also form a continuous or discontinuous thin sheath around the core. The sheath thickness can be in the range of about 0.5% to about 15% of the largest radius of the fiber core. Higher sheath thicknesses can reduce the degree of spiral twist that can be developed and thereby result in reduced stretch properties. The sheath can help with adhesion of the wings to the core by providing more contact points between the core and wing polymers, a particularly useful feature if the polymers in the multiple component fiber do not adhere well to each other. The sheath can also reduce abrasive contact between the core and rolls, guides, and the like, especially when the fiber has a low number of wings. FIG. 3 shows a cross-section of a two-winged fiber having a sheath 16.

The high elasticity of the fiber core permits it to absorb compressional, torsional, and extensional forces as it is twisted by the attached wings when the fiber is stretched and relaxed. These forces can cause de-lamination of the wing and core polymers if their attachment is too weak. Bonding between the core and wing components can be enhanced by selection of one or more of the wing(s) and core compositions or by the use of a sheath as earlier described and/or the use of additives to either or both polymers which enhance bonding. Additives can be added to one or more of the wings, such that each wing has the same or different degrees of attachment to the core. Typically, the core and wing polymers are selected such that they have sufficient compatibility to bond to each other such that separation is minimized while the fibers are being made and in later use.

Additives to the wing and/or core polymers can improve adhesion. Examples include maleic anhydride derivatives (Bynel® CXA, a registered trademark of Dupont or Lotader® ethylene/acrylic ester/maleic anhydride terpolymers from Atofina) that can be used to modify a polyether-amide elastomer to improve its adhesion to a polyamide. As another example, a thermoplastic novolac resin, (HRJ12700 from Schenectady International), having a number average molecular weight in the range of about 400 to about 5000, can be added to an elastomeric (co)polyetherester core to improve its adhesion to (co)polyamide wings. The amount of novolac resin should be in the range of 1-20 wt %, with a more preferred range of 2-10 wt %. Examples of the novolac resins useful herein include, but are not limited to, phenol-formaldehyde, resorcinol-formaldehyde, p-butylphenol-formaldehyde, p-ethylphenol-formaldehyde, p-hexylphenol-formaldehyde, p-propylphenol-formaldehyde, p-pentylphenol-formaldehyde, p-octylphenol-formaldehyde, p-heptylphenol-formaldehyde, p-nonylphenol-formaldehyde, bisphenol-A-formaldehyde, hydroxynapthaleneformaldehyde and alkyl-(such as t-butyl-) phenol modified ester (such as penterythritol ester) of rosin (particularly partially maleated rosin). PCT publication WO 2001016232, which is incorporated by reference herein, discloses techniques to provide improved adhesion between copolyester elastomers and polyamide.

Polyesters functionalized with maleic anhydride ("MA") can also be used as adhesion-promoting additives. For, example, poly(butylene terephthalate) ("PBT") can be functionalized with MA by free radical grafting in a twin screw extruder, according to J. M. Bhattacharya, *Polymer International* (August, 2000), 49: 8, pp. 860-866, incorporated by reference herein. Bhattacharya also reported that a few weight percent of the resulting PBT-g-MA was used as a compatibilizer for binary blends of poly(butylene terephthalate) with nylon 66 and poly(ethylene terephthalate) with nylon 66. Such an additive can also be used to more firmly adhere (co)polyamide wings to a (co)polyetherester core of the fiber of the present invention.

It has been found that splitting (de-lamination) within the fibers of polymeric components that have poor adhesion to each other can be substantially reduced or eliminated if one of the polymeric components comprising the fiber penetrates the other polymeric component. That is, at least a portion of a wing polymer of one or more wings protrudes into the core polymer or at least a portion of the core polymer protrudes into a wing polymer. Such behavior was unexpected because it was anticipated that, under stress, the elastomeric polymer would readily deform and pull out of the interpenetrated connection with the non-elastomeric polymer.

Figure 5:
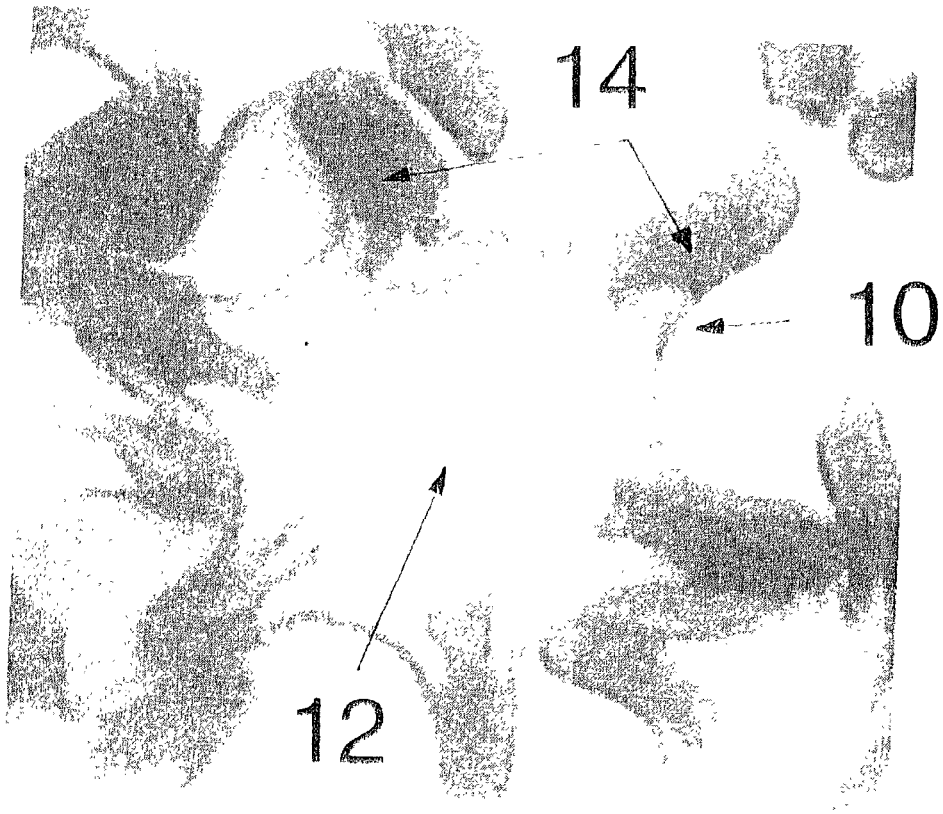
FIG. 5 is a photomicrographic cross-section of a six-winged fiber wherein a portion of the elastomeric core penetrates the wings to form a plurality of protrusions in each wing.
Figure 6:
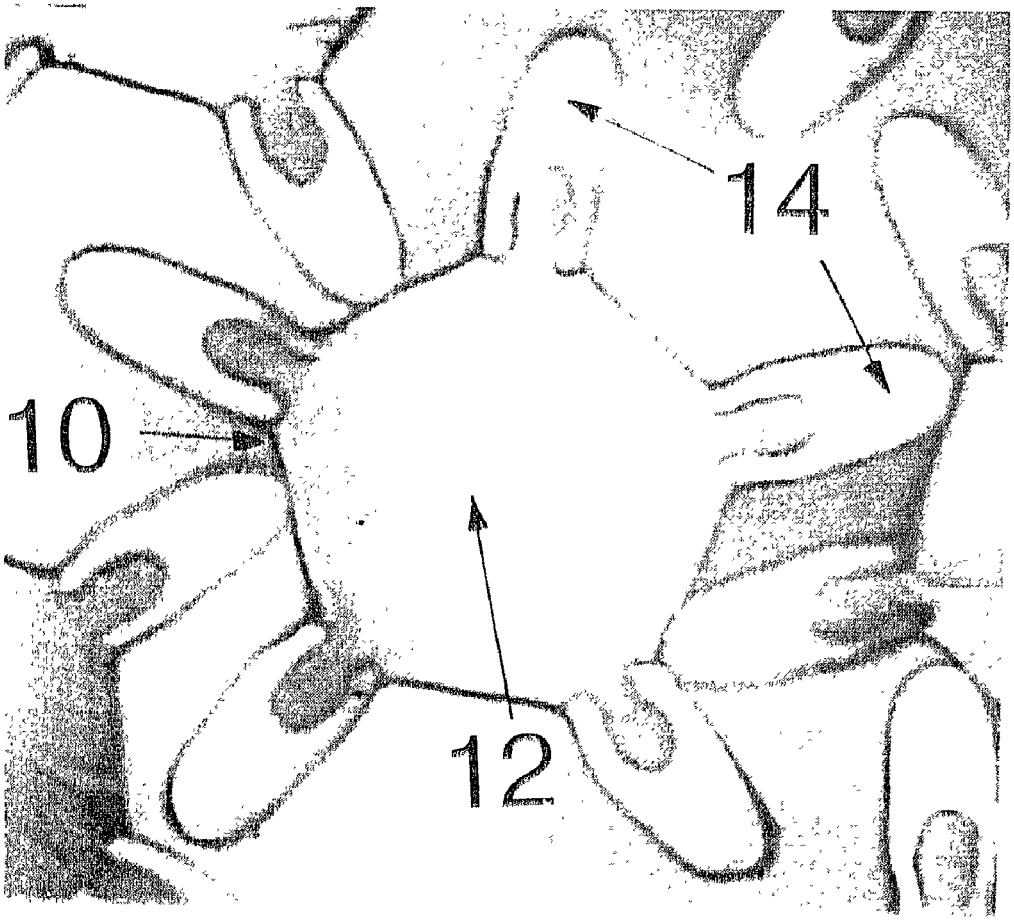
FIG. 6 is a photomicrographic cross-section of a five-winged fiber wherein a portion of the elastomeric core penetrates each wing and wherein each penetrating section of the core has a necked section adjacent the core and an enlarged section remote to the core so that the wings and core are mechanically locked together.
Figure 7:
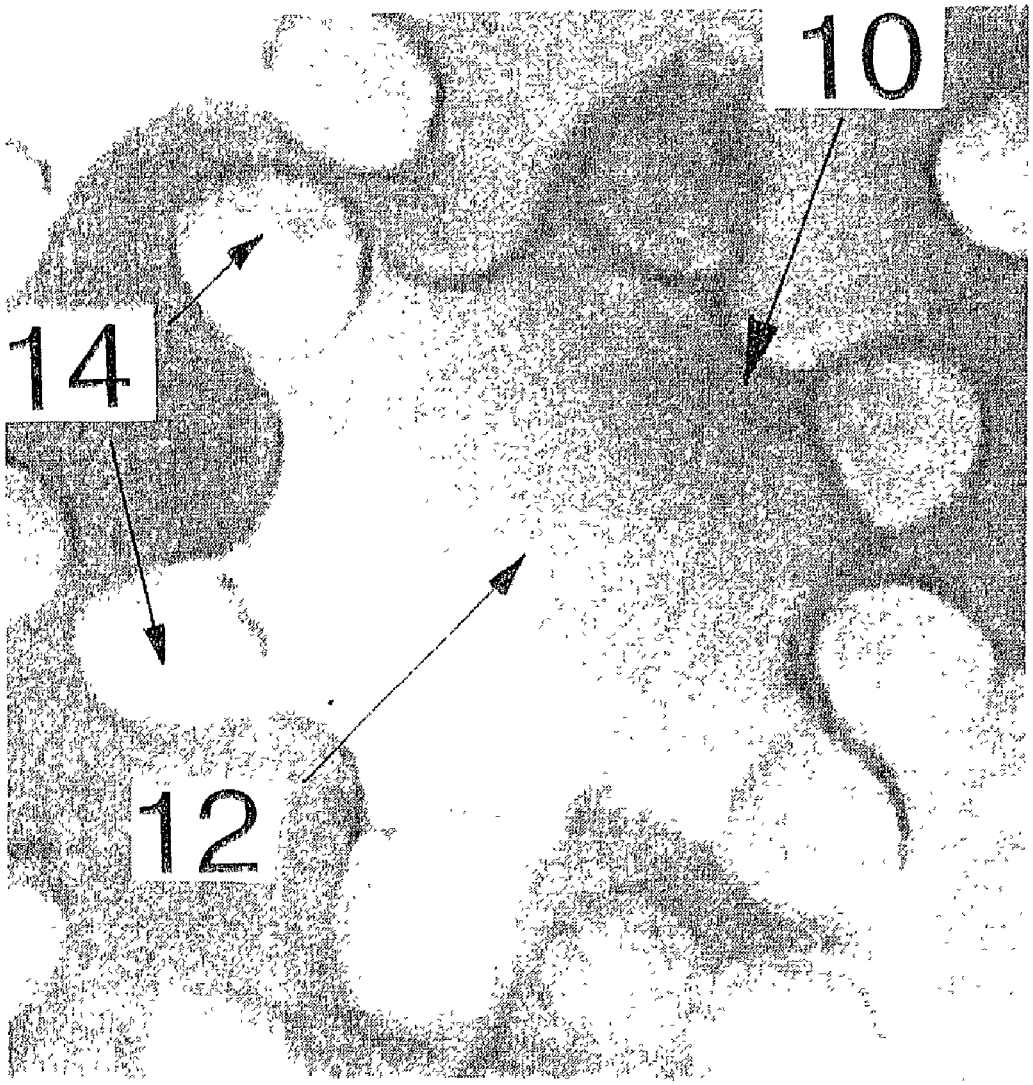
FIG. 7 is a photomicrographic cross-section of a six-winged fiber in which the core surrounds a portion of the sides of the wings so that the wings penetrate the core.

The penetration of core and wing polymers can be accomplished by any method effective for reducing splitting of the fiber. For example, in one embodiment the penetrating polymer (for example the core polymer) can protrude so far into the penetrated polymer (for example the wing polymer), that the penetrating polymer is like a spline (see FIG. 4). A spline has substantially uniform diameter. In another embodiment, the penetrating polymer (for example the wing polymer) can protrude into the penetrated polymer (for example the core polymer) like the roots of a tooth, so that a plurality of protrusions are formed (see FIG. 5). In yet another embodiment, at least one polymer can have at least one protruding portion, of a single wing into core or core into wing, which includes a remote enlarged end section and a reduced neck section joining the end section to the remainder of the at least one polymer to form at least one necked-down portion therein, as illustrated in FIG. 6. Wings and core attached to each other by such an enlarged end section and reduced neck section are referred to as "mechanically locked". For ease of manufacture and more effective adhesion between wings and core, the last-mentioned embodiment having a reduced neck section is often preferred. Other protrusion methods can be envisioned by those skilled in the art. For example, as seen in FIG. 7, the core can surround a portion of the sides of one or more wings, such that a wing penetrates the core. For best adhesion between the core and wings, typically about 5 to 30 weight percent of the total fiber weight can be either non-elastic or less elastic wing polymer penetrating the core or elastic core polymer penetrating the wings.

Figure 9:
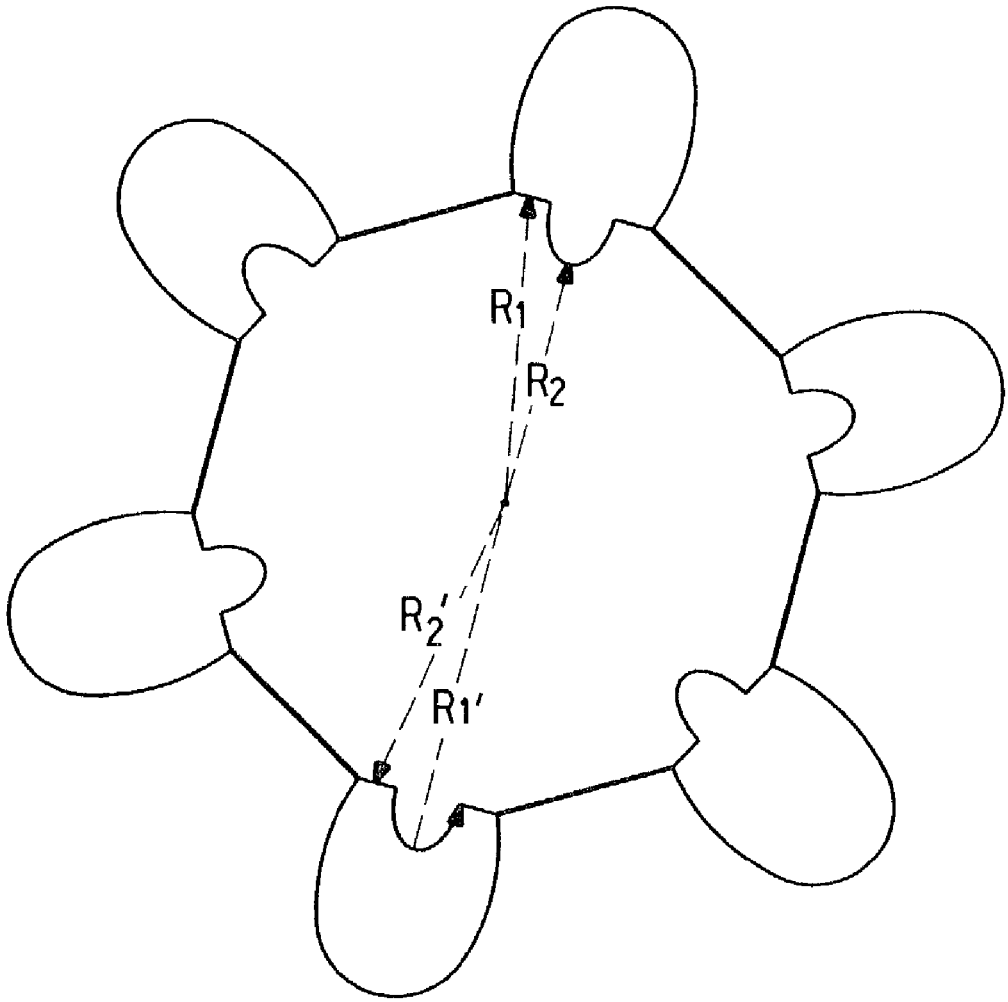
FIG. 9 is a schematic cross-sections of a six-winged fiber in which alternating wings penetrate the core and the core penetrates the remaining wings.

In embodiments wherein either the core component or the wing component penetrates the other, the fiber has an axial core with an outer radius and an inner radius (for example $R_1$ and $R_2$ and $R_1'$ and $R_2'$, respectively, as in FIG. 9. The outer radius is that of a circle circumscribing the outermost portions of the core, and the inner radius is that of a circle inscribing the innermost portions of the wings. In the fibers used in the nonwoven fabrics of the present invention, $R_1/R_2$ is generally greater than about 1.2. It is preferred that $R_1/R_2$ be in the range of about 1.3 to about 2.0. Resistance to de-lamination can decline at lower ratios, and at higher ratios the high levels of elastomeric polymer in the wings (or of non-elastomeric polymer in the core) can decrease the stretch and recovery of the fiber. When the core forms a spline within the wing, $R_1/R_2$ approaches 2. In contrast, in FIG. 2 where there is no penetration of one component into the other, $R_1$ approximates $R_2$. In cases where there is a plurality of wings and the polymer in some wings of the fiber penetrates the core polymer, while the polymer in other wings is penetrated by the core polymer, $R_1$ and $R_2$ are determined only as pairs corresponding to each wing, as illustrated in FIG. 9, and each ratio $R_1/R_2$ and $R_1'/R_2'$ is generally greater than about 1.2, preferably in the range of about 1.3 to 2.0. In another embodiment, some wings can be penetrated by core polymer while adjacent wings are not penetrated, and $R_1$ and $R_2$ are determined in relationship to penetrated wings. Similarly, $R_1$ and $R_2$ are determined in relationship to penetrating wings when only some parts of the core are penetrated by wing polymer. Any combination of core into wing, wing into core, or essentially no penetration can be used for the wings.

The weight ratio of total wing polymer to core polymer can be varied to impart the desired mix of properties, e.g., desired elasticity from the core and other properties from the wing polymer. For example, a weight ratio of wing polymer to core polymer in the range of about 10/90 to about 70/30, preferably about 30/70 to about 40/60 can be used.

The core and/or wings of the multi-winged fibers used in the nonwoven webs of the present invention can be solid or include hollows or voids. Typically, the core and wings are both solid. Moreover, the wings can have any shape, such as ovals, T-shape, C-shape, or S-shapes (see, for example, FIG. 3 which has a C-shape). Examples of useful wing shapes are found in U.S. Pat. No. 4,385,886 incorporated by reference herein. T-shapes, C-shapes, or S-shapes can help protect the elastomer core from contact with guides and rolls as described previously. The core can also have any shape including round, oval, and polyhedral.

Figure 4:
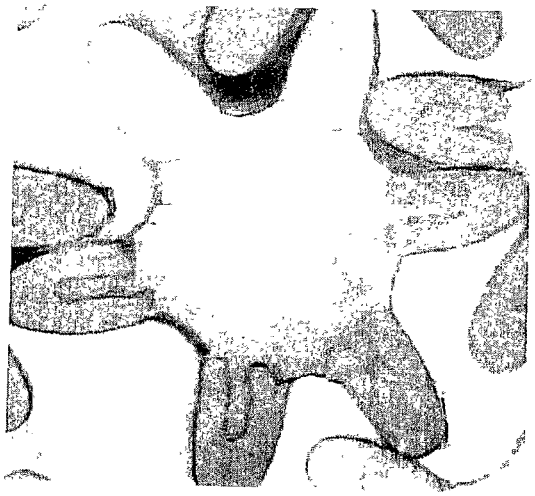
FIG. 4 is a photomicrographic cross-section of a six-winged fiber wherein a portion of the elastomeric core penetrates the wings in the form of a single spline penetrating each wing.

When stretchable spunbond nonwoven fabrics having low bulk and a flat, smooth, uniform surface are desired, the fibers preferably have a substantially radially symmetric cross-section. For maximum cross-sectional radial symmetry, the core can have a substantially circular or a regular polyhedral cross-section, e.g., as seen in FIG. 2. By "substantially circular" it is meant that the ratio of the lengths of two axes crossing each other at 90° in the center of the fiber cross-section is no greater than about 1.2:1. The use of a substantially circular or regular polyhedron core, in contrast to the cores of U.S. Pat. No. 4,861,660, can protect the elastomer from contact with rolls during melt-spinning or spunbond processes, as described with reference to the number of wings. The plurality of wings can be arranged in any desired manner around the core, for example, discontinuously as depicted in FIG. 2 or with adjacent wing(s) meeting at the core surface, e.g., as illustrated in FIGS. 4 and 5 of U.S. Pat. No. 3,418,200. The wings can be of the same or different sizes, provided a substantially radial symmetry is preserved. When axially symmetric multiple component multi-winged fibers having greater than two polymeric components are prepared, two or more wings can be formed from a different polymer from the other wings, once again provided substantially radial geometric and polymer composition symmetry is maintained. However, for simplicity of manufacture and ease of attaining radial symmetry, it is preferred that the wings be of approximately the same dimensions, and be made of the same polymer or blend of polymers. While the fiber cross-section can be substantially symmetrical in terms of size, polymer composition, and angular spacing around the core, it is understood that small variations from perfect symmetry generally occur in any spinning process due to such factors as non-uniform quenching or imperfect polymer melt flow or imperfect spinning orifices. It is to be understood that such variations are permissible when spinning fibers having radially symmetric cross-sections provided that they are not of a sufficient extent to provide undesirable bulkiness to the nonwoven fabric. In preparing non-bulky nonwoven fabrics according to the present invention, the stretch and recovery occurs via one-dimensional spiral twist, while minimizing three-dimensional crimping.

Fibers having a radially asymmetric cross-section can develop higher dimensional crimp, generally upon appropriate heat treatment. In such higher dimensional crimping, a fiber's longitudinal axis itself assumes a zig-zag or helical or other non-linear configuration which leads to nonwoven fabrics having higher bulk than those prepared from fibers having substantially radially symmetric cross-sections.

Radially asymmetric cross-sections can be achieved in a number of ways. For example the spacing between adjacent wing components can be unequal or the lengths and/or shape of one or more of the wings can be different so that rotation of a fiber about its longitudinal axis by 360°/n, in which "n" is an integer greater than 1, results in a substantially different cross-section than before rotation. Different polymers can be used in one or more of the wings in order to generate compositional asymmetry. For example when the elastomeric core polymer is the low-melting polymer component in the multiple component fibers, one or more of the wings can comprise the elastomer in order to improve thermal bonding by making the elastomer more available for bonding. All or part of one or more of the wings can comprise the elastomer. For example a wing segment can comprise a permanently drawable non-elastomeric polymer with an elastomeric polymer or other polymer having a melting point less than the melting point of the core polymer located on at least a portion of the outer surface of the wing.

Figure 10:
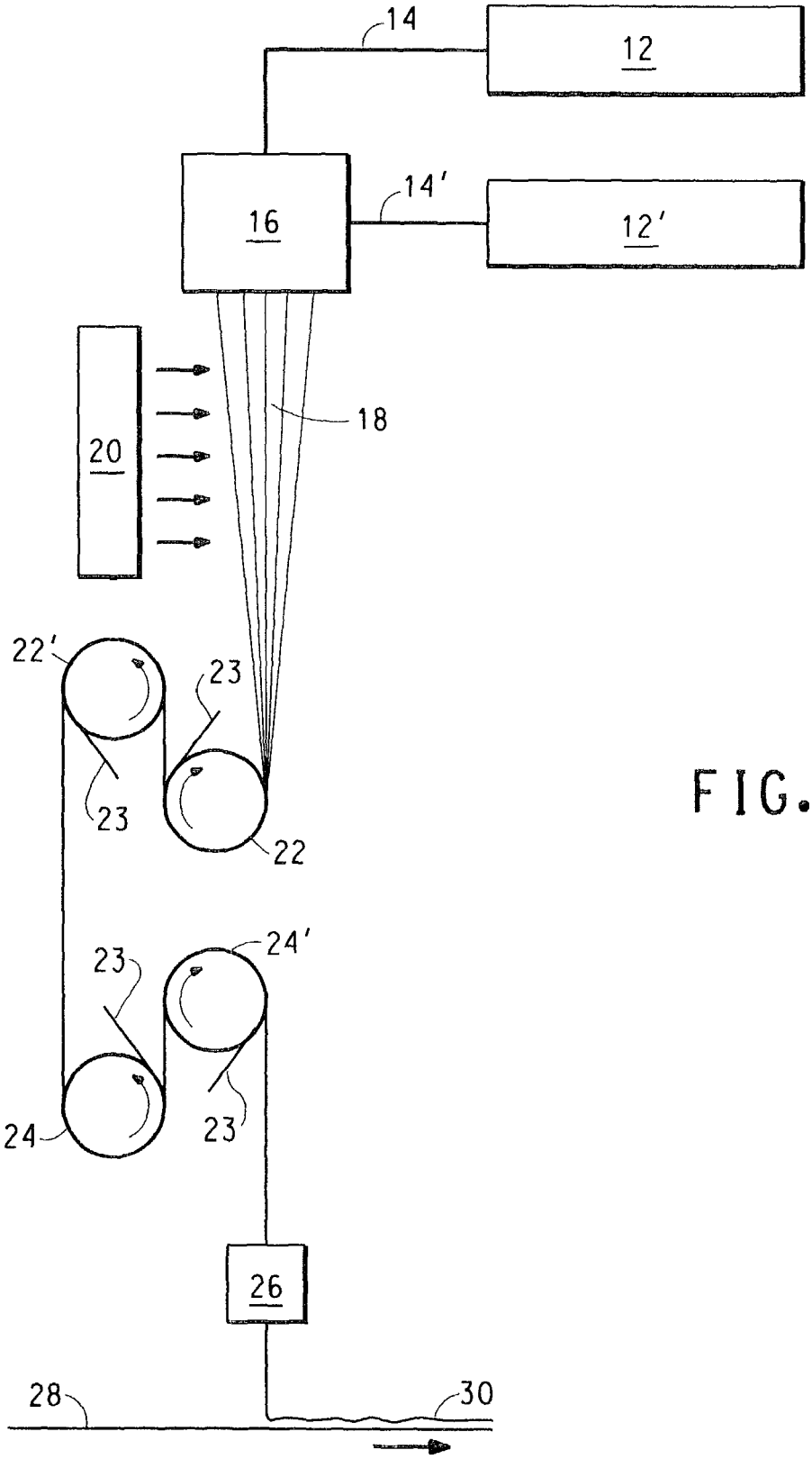
FIG. 10 is a schematic side-view of a spunbond process suitable for forming the stretchable nonwoven fabrics of the current invention.

FIG. 10 is a schematic side view of a process line according to the present invention for preparing a bicomponent spunbond fabric with recoverable stretch utilizing the above-described multi-winged multiple component fibers. The process line includes two separate polymer extrusion systems for separately extruding a polymer A and a polymer B. Polymer A is a thermoplastic elastomer and polymer B is a permanently drawable hard polymer.

As may be required, polymers A and B can be dried to the desired moisture content with heated dry air using methods known in the art, such as a vertical hopper type dryer (not shown). The air temperature is chosen based on the "stick" point of the resins and is typically about 100° C. The air dew point is preferably below −20° C. For example, when the polymer combination is Hytrel® 3078 copolyetherester elastomer and Crystar® 4446 co-polyester, both resins are preferably dried to a moisture content of less than 50 ppm. Certain elastomeric polymers and hard polymers do not require drying prior to processing. For example, Engage® ethylene/1-octene copolymer resins available from Dow Chemical Company and other polyolefin hard polymers such as high density polyethylene, linear low density polyethylene, and isotactic polypropylene generally do not require drying.

The process line includes two extruders 12 and 12' for separately extruding elastomeric polymer A and hard polymer B. The polymers are fed as molten streams from the extruders through respective transfer lines 14 and 14' to a spin beam 16 where they are extruded through a spinneret comprising multiple component extrusion orifices configured to provide the desired multi-winged cross-section. Spinnerets for use in spunbond processes are known in the art and generally have extrusion orifices arranged in one or more rows along the length of the spinneret. The spin beam generally includes a spin pack which distributes and meters the polymer. Within the spin pack, the first and second polymer components flow through a pattern of openings arranged to form the desired filament cross-section such as those described above wherein elastomeric polymer A forms the filament core and hard polymer B forms a plurality of wing components attached to the elastomeric core.

The polymers are spun from the extrusion orifices of the spinneret to form a plurality of vertically oriented filaments which creates a curtain of downwardly moving filaments. In the embodiment shown in FIG. 10, the curtain is formed from three rows 18 of filaments extruded from three rows of bicomponent extrusion orifices. The spinneret can be a pre-coalescence spinneret wherein the different molten polymer streams are brought together prior to exiting the extrusion orifice and are extruded as a layered polymer stream through the same extrusion orifice to form the multiple component spunbond filaments. Alternately, a post-coalescence spinneret can be used wherein the different molten polymer streams are contacted with each other after exiting the extrusion orifices to form the multiple component spunbond filaments. In a post-coalescence process, the different polymeric components are extruded as separate polymeric strands from groups of separate extrusion orifices which join with other strands extruded from the same group of extrusion orifices to form a single multiple component filament.

The extrusion orifices in alternating rows in the spinneret can be staggered with respect to each other in order to avoid "shadowing" in the quench zone, where a filament in one row blocks a filament in an adjacent row from the quench air. The filaments are preferably quenched using a cross-flow gas quench supplied by blower 20. Generally, the quench gas is air provided at ambient temperature (approximately 25° C.) but can also be either refrigerated or heated to temperatures between about 0° C. and 150° C. Alternately, quench gas can be provided from blowers placed on opposite sides of the curtain of filaments.

The length of the quench zone is selected so that the filaments are cooled to a temperature such that no further drawing occurs as they exit the quench zone and such that the filaments do not stick to each other. It is not generally required that the filaments be completely solidified at the exit of the quench zone.

The filaments are drawn in the quench zone, near the spinneret face, due to the tension provided by feed rolls 22 and 22'. This is generally done at relatively low speeds, preferably between about 300 and 3000 meters/minute and more preferably between about 150 to 1000 meters/minute (measured as the surface speeds of feed rolls 22 and 22' in FIG. 10). After exiting the quench zone, a spin finish, such as a finish oil, can be applied to the filaments, for example by contacting the filaments with a licker roll (not shown) which is coated with finish and which is running at a slower speed than the filaments. For example, if a nonwoven fabric having antistatic properties is desired, an antistatic finish can be applied to the filaments. When spin finishes are used, more than two rolls per set of serpentine rolls can be used if the finish oil reduces the friction between the rolls and filaments, increasing the likelihood of slippage of the filaments on the rolls resulting in a reduction in throughput and a failure to segment the tension between the quench, draw, and laydown zones. For example, the tension imposed in the draw zone can be fed back into the spin zone lowering the effective mechanical draw and reducing the crimp and degree of spiral twist that is achieved in the final fibers. This is especially an issue in the process of the present invention, where single wraps of filaments on the rolls are used, instead of multiple wraps that would typically be used in a conventional melt spinning process. A higher number of rolls also increases the possibility of roll wraps. For purposes of economy, the process is preferably conducted with no spin finish ("finish-free") and using two rolls in each set of serpentine rolls.

Figure 11A:
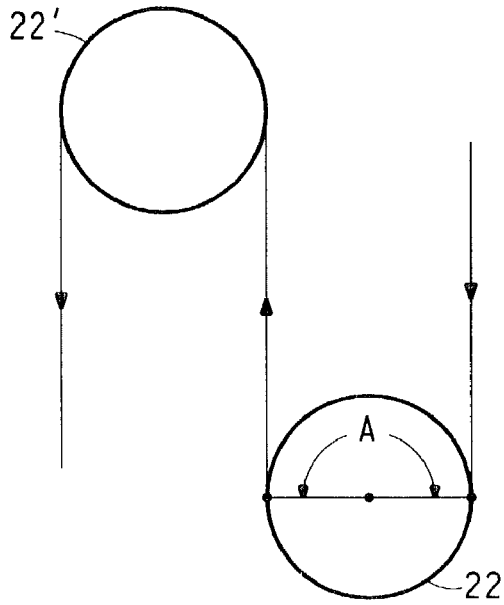
FIGS. 11A and 11B are schematic drawings of two different configurations of serpentine draw rolls suitable for use in the spunbond process of FIG. 10.
Figure 11B:
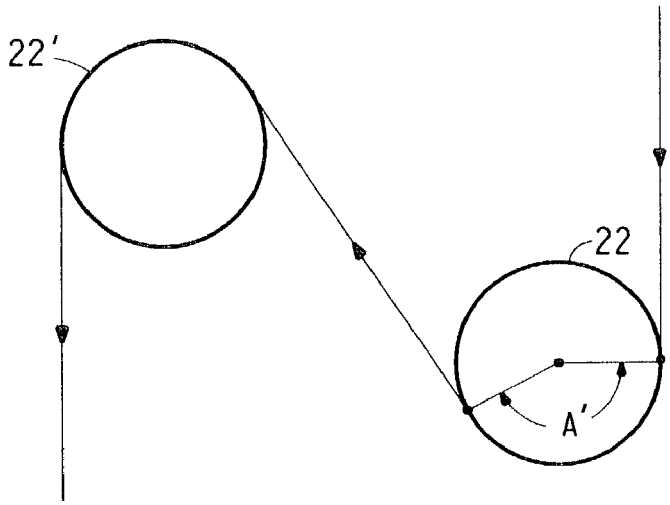

The curtain of vertically oriented quenched multiple component filaments is passed sequentially under and over two sets of driven serpentine rolls with a single filament wrap on each roll. The first set of serpentine rolls 22 and 22' are referred to herein as the feed rolls and the second set of serpentine rolls 24 and 24' are referred to as the draw rolls. Each set of serpentine rolls comprises at least two rolls. In the embodiment shown in FIG. 10, two sets of serpentine rolls, each set consisting of two rolls, are used. However, it should be understood that more than two rolls per set of serpentine rolls can be used. Preferably the rolls are positioned to provide the greatest contact between the filaments and the roll. In FIGS. 11A and 11B, two different serpentine roll configurations are shown. In FIG. 11A, the wrap angle θ, defined as the angle at the center of the roll measured between points where the filaments first contact the roll and the point at which they exit the roll, is 180 degrees. In FIG. 11B, the wrap angle θ' is less than 180 degrees. Wrap angles of about 180 degrees and higher are preferred since that provides increased contact and friction between the filaments and the rolls, resulting in less slippage. Contact angles up to about 270 degrees can generally be used.

The feed rolls, 22 and 22', are rotated at approximately equal speeds but in opposite directions as indicated by the arrows, and are heated to a temperature that stabilizes the location of the draw point. Preferably the feed rolls are operated at a surface speed of between about 150 to 1000 meters/minute. The feed rolls are preferably maintained at a temperature between about room temperature (generally about 25° C.) and about 110° C. If the feed roll temperature is too high, the filaments will stick to the rolls and if the feed roll temperature is too low, a stable draw point is not obtained. Alternately, the filaments can be heated between the two sets of serpentine rolls, such as by using a steam jet (100° C.) or other heating means, such that the filaments are drawn at a localized point between the two sets of rolls.

The drawn filaments are then passed under and over a second set of rolls, serpentine draw rolls 24 and 24', both rotating in opposite directions at approximately equal speeds. The surface speed of the draw rolls are greater than the surface speed of feed rolls 22 and 22' so as to provide the tension required to draw the filaments between the feed rolls and draw rolls. The surface speed of the draw rolls is preferably between about 2000 and 5000 meters/minute. Second draw roll 24' can be run at a slightly higher speed than first draw roll 24. In an embodiment wherein the spunbond filaments have a five-winged cross-section and using a polymer combination of Hytrel® 3078 and Crystar® 4446, feed roll speeds of 400 to 800 m/min and draw roll speeds of 2500 to 3500 m/min are preferred.

The speeds of the draw rolls are set such that the filaments are mechanically drawn between the feed and draw rolls at a draw ratio between about 1.4:1 and 6:1. Preferably, the draw ratio is between about 3.5:1 and 4.5:1. It has been found that maximization of the draw ratio between the feed rolls and the draw rolls results in maximization of elasticity development in the spunbond filaments and the resulting spunbond fabrics.

The maximum operating speed as defined by the surface speed of the draw rolls can reach up to about 5200 meters/minute. At speeds greater than this, excessive filament breaks can occur. When heated feed rolls are used, the filaments are drawn at a point close to where the filaments leave feed roll 22' (i.e., where the filaments are the hottest) and tension from the second set of rolls is first applied so that the drawing is complete before the filaments contact draw roll 24. The filaments preferably have a denier per filament of about 2 to 5 after drawing, however, an effective process with filaments having a denier per filament of about 1 to 20 can be possible without significant process modification.

Feed rolls 22 and 22' and draw rolls 24 and 24' are optionally equipped with filament "strippers" 23 which extend for substantially the length of the driven rolls and lightly contact the rolls immediately downstream of the filament take-off points for each roll. The filament strippers 23 are generally located tangent to the rolls, but the appropriate angle and mounting needed to use the filament strippers are easily determined by one skilled in the art for a given machine and set of process circumstances. The filament strippers 23 can be made from any reasonably stiff card or film stock which does not have a tendency to melt on the surface of the feed or draw rolls. Kapton® film and NOMEX® paper, both available from DuPont, have been found to be suitable for use in the present invention. The strippers help to prevent roll wraps caused by broken filaments by stripping off the boundary layer of air adjacent to each roll surface and causing the broken filament to be thrown in the air and to fall onto the web and proceed through the process rather than forming a roll wrap.

After drawing, the filaments are passed through forwarding or throw-down jet 26, which provides the tension, required to prevent the filaments from slipping on the draw rolls. After exiting the forwarding jet, the tension on the filaments is released. For certain hard wing polymers, particularly those having relatively low glass transition temperatures, some degree of spiral twist develops as the filaments exit the jet. The wing polymer, which is a hard polymer and deforms permanently during drawing, is stable in the extended state and therefore does not retract to any significant degree as the filaments exit the jet. If the temperature of the filaments is above the glass transition temperature ($T_g$) of the wing polymer, the core retracts to some degree after the filaments exit the jet due to the release of tension, causing a decrease in the length of the filaments as the wings form a spiral configuration along the core. When the hard polymer is a polyolefin such as linear low density polyethylene, high density polyethylene, or polypropylene, some degree of spontaneous spiral twist formation can occur as the filaments exit the forwarding jet. When the hard polymer wings have a Tg that is higher than the temperature of the filaments as they exit the forwarding jet, substantially no spiral twist formation generally forms until an additional heat treatment step is executed. The heat treatment step is generally conducted at a temperature greater than $T_g$ of the hard polymer. In the absence of substantial spiral twist development, the wings extend substantially longitudinally straight along the length of the fiber until appropriate heat treatment is conducted. Upon development of spiral twist, the wings form a spiral configuration extending along the length of the fiber. The spiral twist can be substantially circumferential (see FIG. 1A) or substantially non-circumferential (see FIG. 1B).

Forwarding jet 26 is typically an aspirating jet which, in addition to maintaining tension on the draw rolls in order to impose a uniform drawing force on the filaments, provides a stream of gas, such as an air jet, to entrain the filaments and expel them onto a moving collector surface such as belt 28 located below the jet to form nonwoven web 30. Standard attenuating jets, for example a slot jet, used in conventional spunbond processes can be used as the forwarding jet. Such aspirating jets are well known in the art and generally include an elongate vertical passage through which the filaments are drawn by aspirating air entering from the sides of the passage and flowing downwardly through the passage. In spunbonding processes which do not utilize draw rolls, the aspirating jet provides the draw tension to provide spin draw in the filaments, whereas in the process shown in FIG. 10, the feed and draw rolls provide the draw tension. Collector 28 is generally a porous screen or scrim. A suction box or vacuum (not shown) can be provided under the belt to remove the air from the forwarding jet and to pin the filaments to the belt once they are deposited thereon.

In a second embodiment of the process of the current invention, the draw rolls can be eliminated so that the forwarding jet serves both as a draw jet to provide the draw tension to draw the filaments near the spinneret face ("spin draw") as well as a forwarding jet to forward the drawn filaments to the collector surface. The draw roll process shown in FIG. 10 is believed to be preferred because it can provide higher draw tension to allow cold drawing between the feed and draw rolls ("mechanical draw"). Mechanical cold drawing generally results in higher molecular orientation than can be achieved by spin draw alone, which occurs at higher temperatures near the spinneret face. The draw roll process of FIG. 10 is believed to result in higher levels of spiral twist development and optionally to higher levels of crimp development than the corresponding draw jet process.

Although the spunbond filaments formed according to the processes described above can have some degree of spiral twist prior to being laid down as a spunbond web, it is generally desirable to subject the filaments or web to a further heat treatment step after the filaments are drawn. The heat treatment step can be conducted before the filaments are formed into a nonwoven web or after a nonwoven web is formed. The heat-treatment temperature is preferably in the range of about 60° C. to about 120° C. when the heating medium is dry air, between about 60° C. and 99° C. when the heating medium is hot water, and about 101° C. to about 115° C. when the heating medium is super-atmospheric pressure steam (for example when treating a web or fibers in an autoclave). The heat treatment step is preferably conducted when the filaments are not under substantial tension.

In a spunbond process such as that shown in FIG. 10, the heat treatment step can include heating the draw rolls to a temperature in the range of about 60° C. to about 120° C., or using atmospheric steam between the draw rolls and the entrance to forwarding jet 26. Heat treatment while the filaments are under tension was not found to be very effective in producing filaments with high levels of spiral twist. Preferably the heat treatment step is conducted by using a heated gas (e.g. heated air) in forwarding jet 26. Upon exiting the heated forwarding jet, the tension on the filaments is released and spiral twist and optionally crimp are developed. Alternately, the relaxation heat treatment can be carried out by application of heat after the fibers exit the forwarding jet, either before they are collected on the forming belt or after they are collected as a spunbond web on the forming belt. The heat treatment can be carried out on the spunbond web in conjunction with the bonding step, such as by using a through-air bonder or a heated consolidation/embosser roller. When the spunbond filaments have an asymmetric cross-section, the relaxation step can cause formation of three-dimensional crimp as well as developing the spiral twist.

After depositing the filaments onto belt 28, the resulting web is generally bonded in-line to form a bonded spunbond fabric which is then wound up on a roll. If the web is bonded in-line, the heat treatment to develop the spiral twist filament configuration as well as any three-dimensional crimp is preferably done prior to bonding in order to maximize spiral twist and optionally crimp development. The web can be lightly compressed by a compression roller prior to bonding. Bonding can be accomplished by thermal bonding in which the web is heated to a temperature at which the low-melting polymeric component softens or melts causing the filaments to adhere or fuse to each other. For example, the web can be thermally point bonded at discrete bond points across the fabric surface to form a cohesive nonwoven fabric. In a preferred embodiment, thermal point bonding or ultrasonic point bonding is used. Typically, thermal point bonding involves applying heat and pressure at discrete spots on the fabric surface, for example by passing the nonwoven layer through a nip formed by a heated patterned calender roll and a smooth roll. During thermal point bonding, the low melting polymeric component is partially melted in discrete areas corresponding to raised protuberances on the heated patterned roll to form fusion bonds which hold the nonwoven layers of the composite together to form a cohesive bonded nonwoven fabric. The pattern of the bonding roll can be any of those known in the art, and are preferably discrete point bonds. The bonding can be in continuous or discontinuous patterns, uniform or random points or a combination thereof. The bond points can be round, square, rectangular, triangular or other geometric shapes. The bond size and bond density are adjusted to achieve the desired fabric properties. Higher bond densities will generally reduce the stretch properties of the nonwoven fabric. Preferably, the spunbond fabrics have an elastic stretch of at least about 10%, more preferably at least about 30%, in the machine and cross directions. The nonwoven web can also be bonded using through air bonding wherein heated gas, generally air, is passed through the web.

The gas is heated to a temperature sufficient to soften or melt the low-melting component to bond the filaments at their cross-over points. Through-air bonders generally include a perforated roller, which receives the web, and a hood surrounding the perforated roller. The heated gas is directed from the hood, through the web, and into the perforated roller. Generally fabrics that have been through air bonded have higher loft than those prepared using thermal point bonding.

Alternately, non-thermal bonding techniques including hydroentangling (hydraulic needling) and needle-punching (mechanical needling) can be used in place of thermal bonding. The nonwoven web can also be bonded using a resin binder. For example, the nonwoven web can be impregnated with a latex resin such as in a dip-squeeze process or coating processes known in the art. Alternately, the nonwoven web can be intermittently bonded by applying the resin to the nonwoven web in a pattern, such as in discrete points or lines.

A preferred elastomeric core polymer for use in preparing elastomeric spunbond fabrics is Hytrel® copolyetherester available from DuPont. For example, fibers comprising a Hytrel® copolyetherester core with wing polymers selected from poly(1,4-butylene terephthalate), poly(trimethylene terephthalate), various co-polyesters, high density polyethylene, linear low density polyethylene, isotactic or syndiotactic polypropylene, and poly(4-methylpentene-1) are suitable. Hytrel® copolyetherester elastomer can also be combined with a hard non-elastomeric Hytrel® polymer in the wing components, such as Hytrel® 7246 (flexural modulus 570 MPa) available from DuPont. Hard and soft Hytrel® polymers are distinguished by the ratio of hard segments to soft segments.

Other combinations include preferred Engage® core polymers with either linear low density polyethylene wings or with high density polyethylene wings that are suitable for forming spiral twist fibers useful in the nonwoven fabrics of the current invention.

Depending on the selection of core and wing polymers, in some cases the core polymer will be the lowest-melting component and in other cases, the wing polymer will be the lowest-melting component. For the combinations Hytrel® elastomeric core/poly(1,4-butylene terephthalate) wings, Hytrel® elastomeric core/co-polyester wings, elastomeric Hytrel®/hard Hytrel® wings, Engage® core/LLDPE wings, and Engage® core/HDPE wings the elastomer is the lowest-melting component so thermal bonding occurs through the core polymer. The number and spacing of the wings can be selected so as to permit good thermal bonding without causing problems with sticking and roll wrap, etc. during the spunbonding process. For the combinations Hytrel® elastomeric core/high density polyethylene wings, Hytrel® elastomeric core/linear low density polyethylene wings, Hytrel® elastomeric core/poly(trimethylene terephthalate wings), and Pellethane® core/HDPE wings, the wing polymer is the lowest-melting polymer component so thermal bonding occurs through the wing polymer. When the nonwoven fabric is a thermally bonded nonwoven fabric, preferably the lowest-melting polymer component has a melting point that is at least 10° C. lower than the melting point of the other polymer components. When one or more of the polymer components does not have a definite melting point, the polymer component with the lowest softening temperature should have its softening temperature at least 10° C. lower than the melting point (or softening temperature) of the other polymer components.

Fibers with polyester-based wings and core (e.g. copolyetherester elastomer core and polyester wings) are preferred for use in end uses requiring fiber dyeability or higher end use temperatures such as apparel end uses. Fibers with polyolefin based wings and core are expected to be suitable for use in end uses that do not require dyeing and have lower end use temperatures such as diaper backings, etc. As such, it would be desirable to use polymers with dye sites. An example would be Hytrel® polyetherester in which some of the polyester segments contain the sodium salt of sulfoisophthalate. The polymers containing the dye sites could be in the wings, the core or both.

Staple fibers used to form staple nonwoven webs including carded, airlaid, and wetlaid nonwoven webs can be formed using spinning methods known in the art. Generally, the melt-spinnable polymers are melted and the molten polymers are extruded through a spinneret capillary orifice designed to provide the desired fiber cross-section. Pre-coalescence or post-coalescence spinneret packs can be used. The extruded fibers are then quenched or solidified with a suitable medium, such as air, to remove the heat from the fibers leaving the capillary orifice. Any suitable quenching method can be used, such as cross-flow, or radial quenching.

Figure 12:
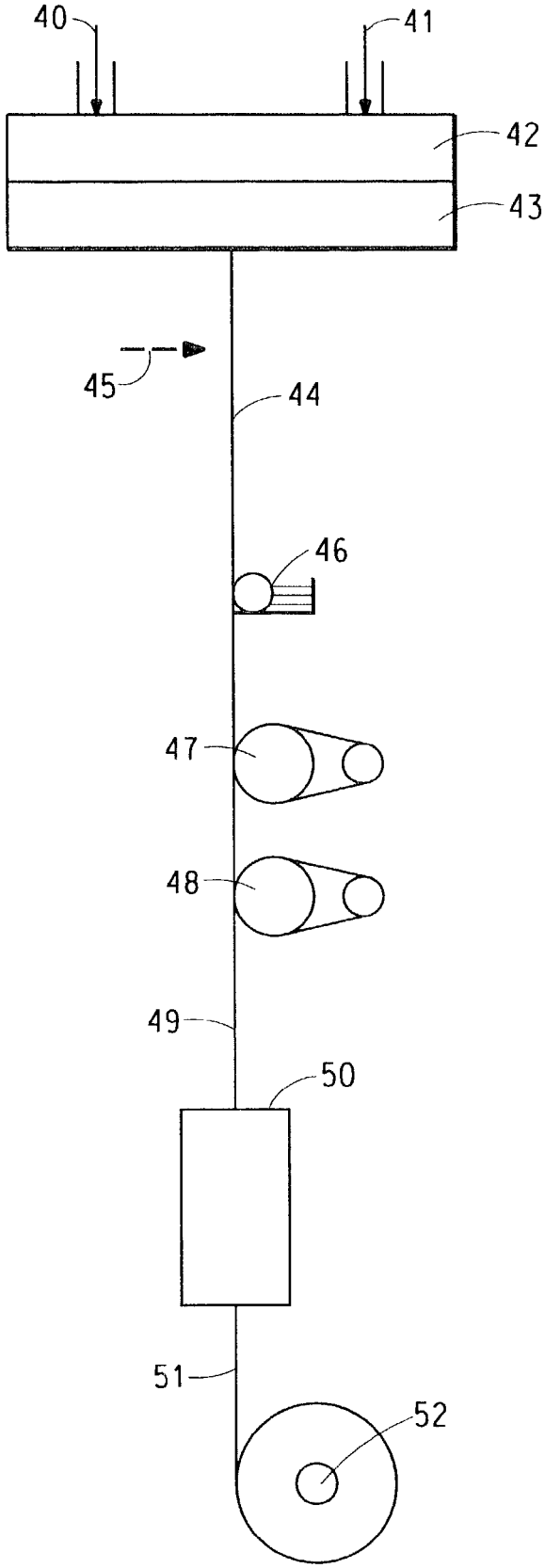
FIG. 12 shows a schematic process useful for making fibers suitable for preparing certain nonwoven fabrics of the invention.

FIG. 12 is a schematic diagram of an apparatus that can be used to make filaments suitable for cutting into staple fibers for use in preparing staple nonwoven webs and fabrics of the present invention. Other apparatus can also be used. A thermoplastic hard polymer supply (not shown) can be introduced at 40 to the spin pack assembly 42 and a thermoplastic elastomeric polymer supply (not shown) can be introduced at 41 to the spin pack assembly 42. The two polymers can be extruded as fiber 44 from spinneret 43 having a capillary designed to give the desired multi-winged cross-section, and quenched in any known manner, for example by cool air 45 and optionally treated with a finish, such as silicone oil optionally with magnesium stearate using any known technique at finish applicator 46. The fibers are then drawn in at least one drawing step, for example between feed roll 47 (which can be operated at 150 to 1000 meters/minute) and draw roll 48. The drawing step can be coupled with spinning to make a fully-drawn yarn or in a split process in which there is a delay between spinning and drawing. Any desired draw (short of that which interferes with processing by breaking fiber) can be imparted to the fibers, for example, a fully oriented yarn can be produced by a draw of about 3.0 to 4.5×. Drawing can be carried out at about 15-100° C., typically at about 15-40° C. The final fiber, after being partly relaxed as described below, can have at least about 35% after-boil-off stretch.

Drawn fibers 49 can optionally be partly relaxed, for example, with steam at 50 in FIG. 12. Any amount of heat-relaxation can be carried out during spinning. The greater the relaxation, the more elastic the fibers, and the less shrinkage that occurs in downstream operations. It is preferred to heat-relax the just-spun fibers by about 1-35% based on the length of the drawn fiber before winding it up, so that it can be handled as a typical hard yarn.

The quenched, drawn, and optionally relaxed fibers 51 can then be collected for example by winding them up at up to about 4000 meters/minute at winder 52. If multiple fibers have been spun and quenched, the fibers can be converged, optionally interlaced, and then wound up at up to about 4000 meters per minute at winder 52. Alternatively, the wind-up speed can be in the range of about 200 to about 3500 meters per minute.

As noted previously, the multi-winged, multiple component fibers can be made in a split process in which there is a delay between spinning and drawing and where the drawn fiber is not wound up on packages before cutting into staple. A thermoplastic hard polymer supply and a thermoplastic elastomeric polymer supply can be introduced to the spin pack assembly as described above. The two polymers can be extruded as fibers from a spinneret having up to 1500 or more capillaries designed to give the desired multi-winged cross-section, and quenched in any known manner, for example by cool air and optionally treated with a finish, such as silicone oil or with magnesium stearate using any known technique. The yarns can be multi-ended into a tow in the range of about 50,000 to 750,000 total denier, optionally treated with a secondary finish, pulled from the quench zone at speeds of about 200 to 1000 meters/minute, and introduced into containers where the tow is compressed to increase packing density and stored until drawing and cutting. The undrawn tow from several containers can be combined to form a tow of about 1 million to 2 million total denier and introduced into a draw machine at speeds of about 100 to 200 meters/minute where it can be drawn 3 to 4.5× in at least one drawing step. The drawn tows of about 300,000 to 500,000 total denier are again stored in containers until ready for cutting. Drawn tows from several containers can be combined to form tows of about 750,000 to 2 million total denier which can be introduced into a rotary type cutter at speeds of about 50 to 250 meters/minute, cut into staple lengths, and packaged in boxes or bales.

Staple fibers used to prepare carded webs are preferably crimped prior to carding. Uncrimped fibers can cause problems as the fibers become stuck between the teeth in the card wire and do not release well. Crimp can be developed during the heat treatment step or the fibers can be mechanically crimped such as in a stuffer box. Generally fibers used for airlay processes have less crimp than those designed for carding. Fibers used to prepare airlaid webs are generally shorter than fibers used in carding processes because if the fibers are too long they become entangled with each other and generally will not disperse well in an airlay process. Fibers used in wet-lay processes preferably have low levels of crimp and are cut to short lengths in order to obtain good dispersion and avoid entangling of the fibers together. Fiber lengths and crimp levels suitable for the various staple web processing methods are well known in the art. For example for airlaid webs, uncrimped fiber lengths of between about 0.5 to 1 inch (1.27-2.54 cm) are preferred. For carded webs, fibers generally have an uncrimped length of about 1.5 inches (3.8 cm) however it is common to use a blend of lengths wherein longer fibers (e.g. approx. 3.8 cm) are used to carry some shorter fibers (e.g. less than 2.54 cm).

At any time after being drawn, the multi-winged multiple component fiber is dry- or wet-heat-treated while substantially fully relaxed to develop the desired stretch and recovery properties. Such heat treatment can be accomplished during fiber production or after the fiber has been incorporated into a multiple component nonwoven fabric, for example during scouring, dyeing, and the like. Heat-treatment in fiber or yarn form can be carried out using hot rolls or a hot chest or in a jet-screen bulking step, for example. It is preferred that such relaxed heat-treatment be performed after the fiber is in a nonwoven fabric so that up to that time it can be processed like a non-elastomeric fiber; however, if desired, the fiber can be heat-treated and fully relaxed to develop the spiral twist before being formed into a nonwoven fabric. For greater uniformity in the final fabric, the fiber can be uniformly heat-treated and relaxed. The heat-treating/relaxation temperature can be in the range of about 80° C. to about 120° C. when the heating medium is dry air, about 75° C. to about 100° C. when the heating medium is hot water, and about 101° C. to about 115° C. when the heating medium is super-atmospheric pressure steam (for example in an autoclave). Lower temperatures can result in little or no relaxation/spiral twist development, and higher temperatures can melt the low-melting polymer component. The heat-treating/relaxation step can generally be accomplished in a few seconds. The multiple component multi-winged fibers can have an after-boil-off stretch of at least about 35%, preferably of at least about 55%.

The orifices and holes through which the molten polymer is extruded can be formed to produce the desired cross-section of the present invention, as described above. The capillaries or spinneret bore holes can be cut by any suitable method, such as by laser cutting, as described in U.S. Pat. No. 5,168,143, herein incorporated by reference, drilling, Electron Discharge Machining (EDM), and punching, as is known in the art. The capillary orifice can be cut using a laser beam for good control of the cross-sectional symmetry of the fiber of the invention. The orifices of the spinneret capillary can have any suitable dimensions and can be cut to be continuous (pre-coalescence) or non-continuous (post-coalescence). A non-continuous capillary can be obtained by boring small holes in a pattern that would allow the polymer to coalesce below the spinneret face and form the multi-winged cross-section of the present invention.

Figure 13:
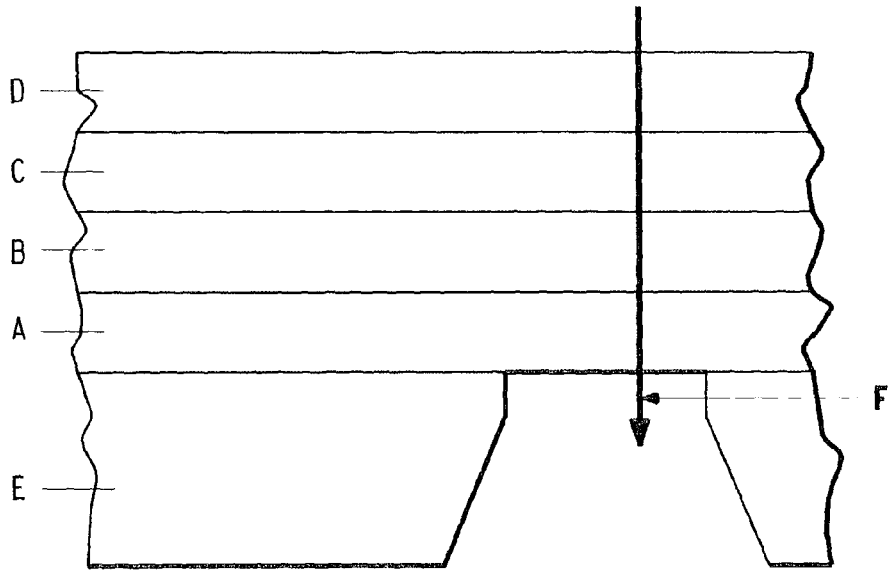
FIG. 13 is a schematic cross-section of a spinneret pack suitable for making fibers used to prepare the nonwoven fabrics of the invention.
Figure 13A:
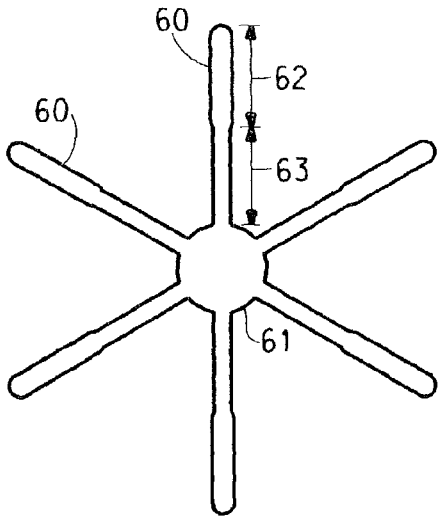
FIG. 13A shows an orifice for a spinneret plate A of FIG. 13.
Figure 13B:
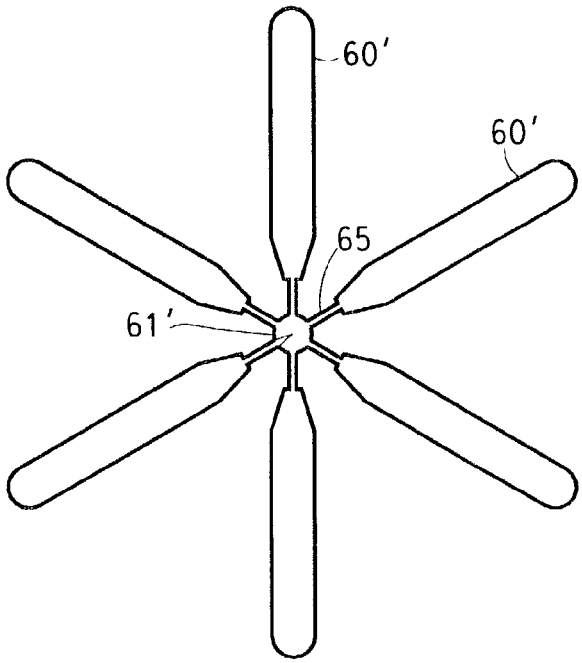
FIG. 13B shows an orifice for a distribution plate B of FIG. 13.

For example, a six-winged fiber having the cross-section shown in FIG. 2 can be made with a precoalescence spinneret pack such as the pack configuration illustrated in FIGS. 13, 13A, 13B, and 13C. Polymer flows in the direction of arrow F in FIG. 13. Melt pool plate D rests on metering plate C, which in turn rests on distribution plate B, which rests on spinneret plate A, which is supported by spinneret support plate E. Melt pool plate D and spinneret support plate E are preferably sufficiently thick and rigid that they can be pressed firmly toward each other, thus preventing polymer from leaking between the various plates. Plates A, B, and C are preferably sufficiently thin that the orifices can be laser-cut. To make fibers having various numbers of wings, the appropriate number of symmetrically arranged orifices are used in each of the plates. As shown in FIG. 13A, spinneret plate A can comprise six symmetrically arranged wing spinneret orifices 60 connected to a central round spinneret hole 61. Each of the wing orifices 60 can have sections of different widths along their length, such as wing sections 62 and 63. As shown in FIG. 13B, distribution plate B can have wing distribution orifices 60' tapering to optional slot 65, which can connect the distribution orifices to central round hole 61'. Metering plate C, shown in FIG. 13C, can have metering holes 60" for the wing polymer and a metering hole 61" for the core polymer. Melt pool plate D can be of conventional design. Spinneret support plate E can have holes which can be large enough and flared away (for example at 45-60°) from the path of the newly spun fiber so that the fiber does not touch the sides of the holes. The plates can be aligned so that core polymer flows from melt pool plate D through central metering hole 61" of metering plate C, through central round hole 61' of distribution plate B, through central round hole 61 of spinneret plate A, and out through large flared holes in spinneret support plate E. At the same time, wing polymer flows from melt pool plate D through wing metering holes 60" of metering plate C, through distribution orifices 60' of distribution plate B (in which, if optional slot 65 is present, the two polymers first make contact with each other), through wing orifices 60 of spinneret plate A, and finally out through the holes in spinneret support plate E.

In one embodiment, the spinneret pack is designed such that the spinneret plate does not have a substantial counterbore, by which is meant that the length of any counterbore present (including any recess connecting the entrances of a plurality of spinneret capillaries) is less than about 60%, such as less than about 40%, of the length of the spinneret capillary. This allows the polymers to be fed directly into the spinneret capillaries. Direct metering of the multiple polymer streams into specific points at the backside entrance of the fiber forming orifice in the spinneret plate eliminates problems in polymer migration when multiple polymer streams are combined in feed channels substantially before the spinneret orifice as is the norm. This embodiment can be used to melt spin filaments suitable for preparing multi-winged staple fibers useful in the nonwoven fabrics of the invention.

The spinneret pack can be modified to achieve different multi-winged fibers, for example, by changing the number of capillary legs for a different desired wing count, changing slot dimensions to change the geometric parameters as needed for production of a different denier per filament, or as desired for use with various synthetic polymers.

Figure 8:
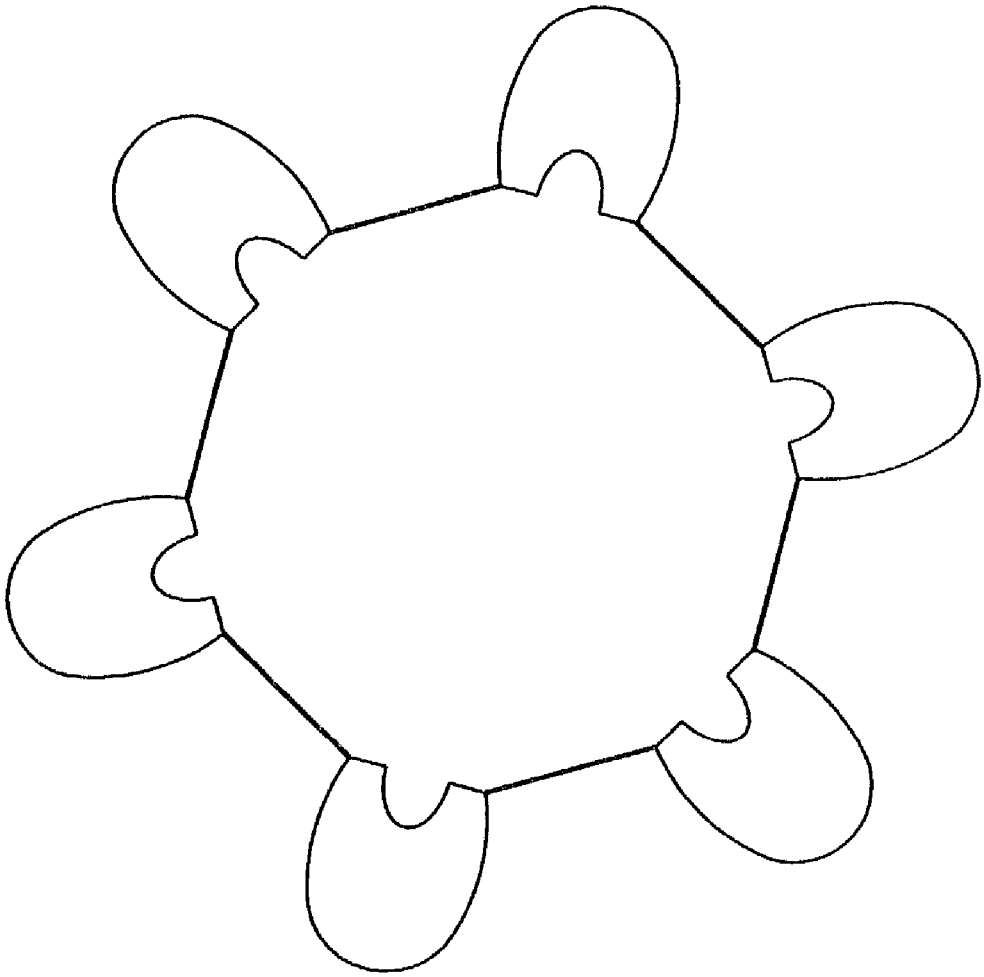
FIG. 8 is a schematic cross-section of a six-winged fiber in which the core protrudes into the wings.
Figure 13C:
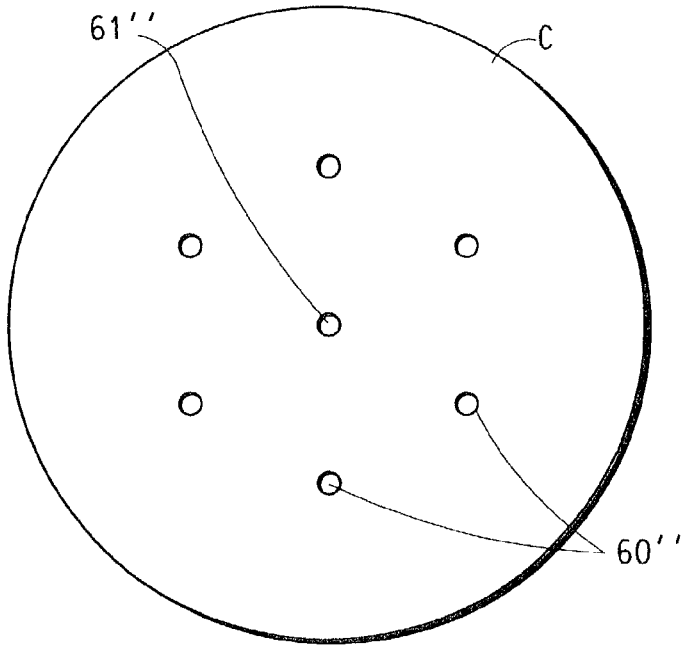
FIG. 13C shows orifices for a metering plate C of FIG. 13.
Figure 13D:
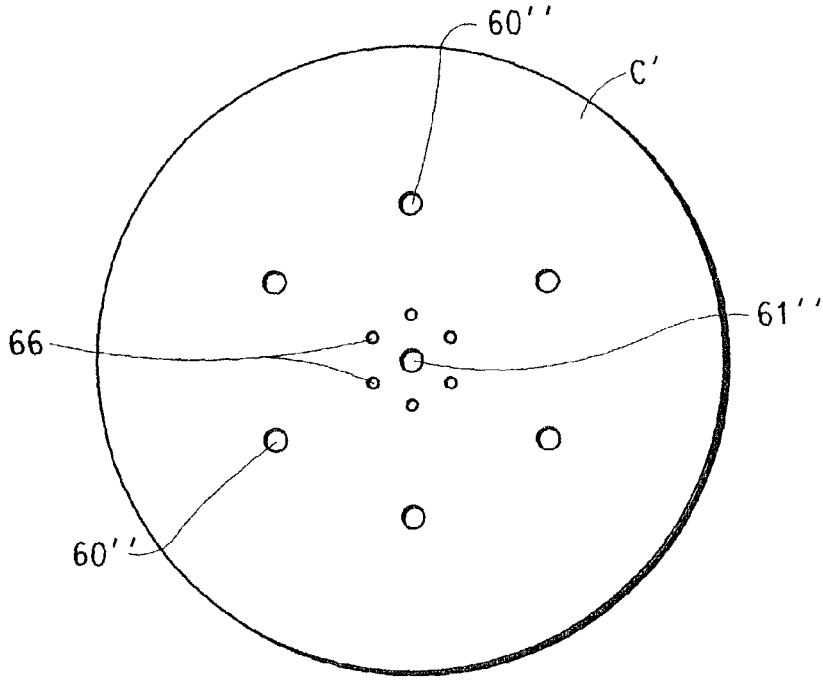
FIG. 13D shows orifices for an alternate metering plate C of FIG. 13 suitable for preparing six-winged fibers wherein the core polymer penetrates the wing polymer.

Replacing metering plate C shown in FIG. 13C with metering plate C' shown in FIG. 13D results in formation of a fiber having a cross-section similar to that described above for FIGS. 13, 13A, 13B, and 13C except that portions of the core elastomer penetrate into the wings resulting in a fiber having a cross-section similar to that depicted in FIG. 8. Metering plate C' is similar to metering plate C except that metering plate C' includes an additional set of holes 66, one per wing and located on the centerline of each wing. Elastomeric core polymer is fed to central hole 61" as well as to holes 66 resulting in penetration of the core polymer into wings. Holes 66 are placed along the centerline of each wing at a position which results in an elastomeric component which penetrates the wing and which combines with the core elastomer, i.e. the penetrating elastomeric component is not encapsulated by the wing polymer but rather combines with the core feed.

Figure 14A:
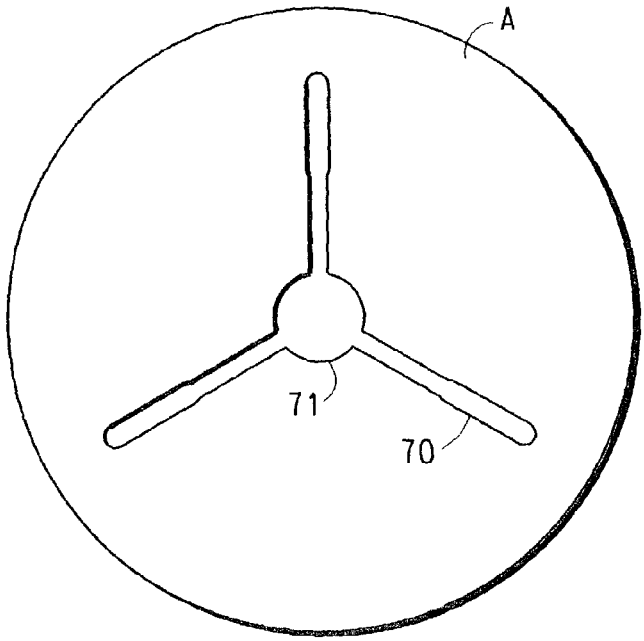
FIGS. 14A, 14B, and 14C show a spinneret plate, distribution plate, and metering plates suitable for forming three-winged fibers useful in preparing the nonwoven fabrics of the invention.
Figure 14B:
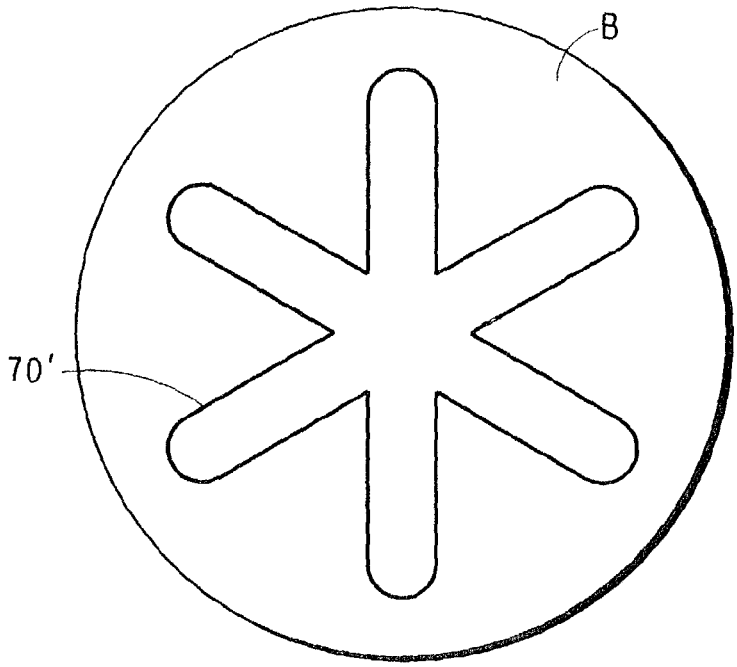
Figure 14C:
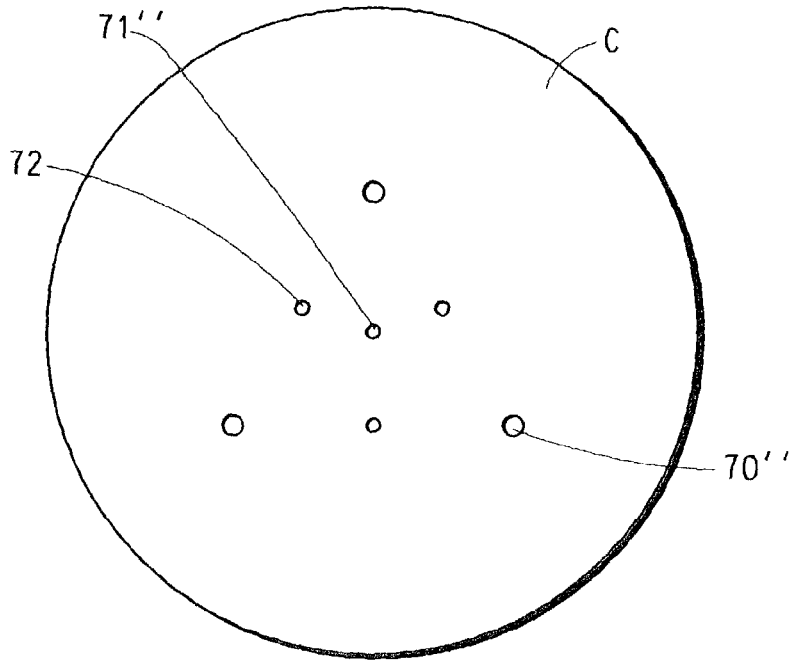
Figure 15:
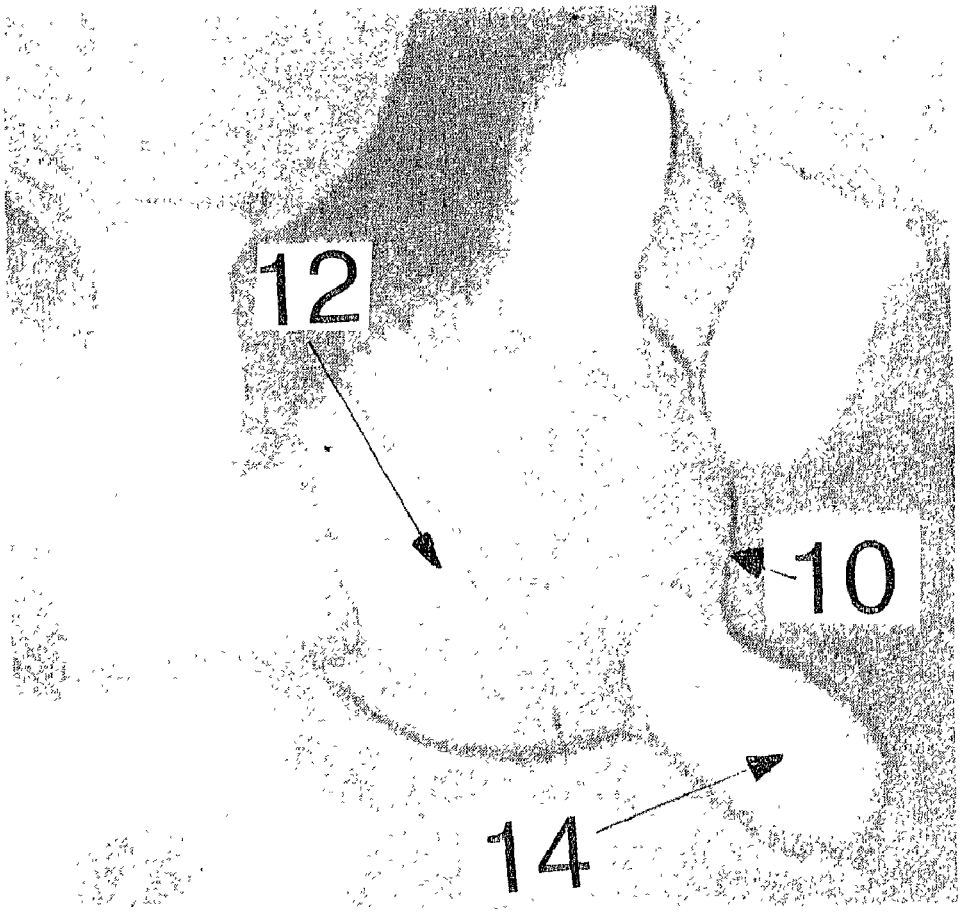
FIG. 15 is a photomicrograph cross-section of three-winged fibers wherein the wings penetrate the core prepared using the spin pack plates shown in FIGS. 14A, 14B, and 14C.

FIGS. 14A, 14B, and 14C show the arrangement of holes in spin pack plates of a pre-coalescence spin pack suitable for preparing a bicomponent three-winged fiber wherein the core is penetrated by the wings. Referring to FIG. 14A, spinneret plate A comprises orifices having three straight wing orifices 70 having two sections of different width arranged symmetrically 120 degrees apart around the circumference of central round spinneret hole 71. Referring to FIG. 14B, distribution plate B comprises six-winged orifices 70' and is co-axially aligned above spinneret plate A so that every other wing orifice 70' is aligned with a wing orifice of spinneret plate A. Referring to FIG. 14C, metering plate C comprises wing holes 70" and central core hole 71". Metering plate C further comprises core polymer holes 72 aligned with the wing orifices of distribution plate B that are not aligned with the wing orifices of spinneret plate A. Metering plate C is aligned with distribution plate B and spinneret plate A such that metering wing holes 70" are aligned with spinneret wing orifices 70. Fibers spun from a spin pack having the plate configurations shown in FIGS. 14A, 14B, and 14C have the cross-section shown in FIG. 15 wherein the wings penetrate the core.

Test Methods

In the description above and in the examples that follow, the following test methods were employed to determine various reported characteristics and properties. ASTM refers to the American Society for Testing and Materials.

Stretch properties (after boil-off stretch, after boil-off shrinkage and stretch recovery after boil-off) of the fibers prepared in Examples 2-5 were determined as follows. A 5000 denier (5550 dtex) skein was prepared by winding the monofilament on a 54 inch (137 cm) reel. Both sides of the looped skein were included in the total denier. Initial skein lengths with a 2 gram weight (length CB) and with a 1000 gram weight (0.2 g/denier) (length LB) were measured. The skein was subjected to 30 minutes in 95° C. water ("boil off"), and initial (after boil off) lengths with a 2 gram weight (length $CA_{initial}$) and with a 1000 gram weight (length $LA_{initial}$) were measured. After measurement with the 1000 gram weight, additional lengths were measured with a 2 gram weight after 30 seconds (length $CA_{30sec}$) and after 2 hours (length $CA_{2hrs}$). Percent absolute shrinkage after boil-off was calculated as 100×(LB−LA)/LB. Percent Stretch after boil off was calculated as 100×(LA−CA@30 sec)/CA@30 sec. Percent recovery after boil-off was calculated as $100\times(LA-CA_{2hrs})/(LA-CA_{initial})$.

Basis Weight is a measure of the mass per unit area of a fabric or sheet and was determined by ASTM D-3776, which is hereby incorporated by reference, and is reported in $g/m^2$.

Frazier Air Permeability is a measure of air flow passing through a sheet at a stated pressure differential between the surfaces of the sheet and was conducted according to ASTM D 737, which is hereby incorporated by reference, and is reported in $(m^3/min)/m^2$.

Flexural Modulus was measured according to ASTM D790 Method 1, Procedure B at 23° C.

Recoverable Elongation was measured for nonwoven fabrics made in Examples 6-8, below after running the fabrics through several programmed elongation cycles. A nonwoven sample (1-inch wide by 3-inch (2.54 by 7.62 cm) gauge length) was clamped in an Instron apparatus and extended at a rate of 3-inches per minute (7.62 cm/min) until it reached the target strain. Upon reaching the target strain, the crossheads reversed direction and moved together at the same velocity, releasing stress on the sample. Each sample was cycled three times in this manner, and then held for 30 seconds. After this hold period, the set was measured by again moving the crossheads apart at 3-inches/min until a load is detected. The length of the sample at this point defines the set, which is calculated according to the following equation:

$$\text{Set}(\%)=100\times\{(\text{final length})-(\text{initial length})\}/(\text{initial length})$$

A set value of zero indicates 100% recoverable elongation. Recoverable elongation is defined as (100%−set %).

To determine the level of elongation a sample can undergo before it starts to be permanently deformed, each sample was tested as described above, but held in the instrument and cycled through this test at progressively higher levels of elongation. For example, the samples tested were cycled three times at 15% elongation, three times at 25% elongation and then three times at 50% elongation without removing the sample. The set was measured after a 30-second rest period at the end of each cycle, and was calculated on the basis of the original unstressed length. The cumulative set was reported for the Examples below. For example, to obtain the set value at 25% elongation, the sample undergoes three cycles to 15% elongation (with a 30-second rest), and three cycles to 25% elongation (with a 30-second rest). The value reported was the measurement at the end of the cycles to 25% elongation.

In the elongation test described above, the force needed to stretch the sample was recorded at various points as the sample was being stretched (load) and as the stress was being released (unload). These two measurements are noted here as being indicative of the "elastic power" (recovery power) of the fabric. In this part, the values measured on the third cycle of the 25% elongation test were compared. The force at 15% elongation on the way up to 25% elongation (load at 15%) and the force at 15% elongation on the way down to 0% elongation (unload at 15%) were compared for each sample.

EXAMPLES

Example 1

Figure 16:
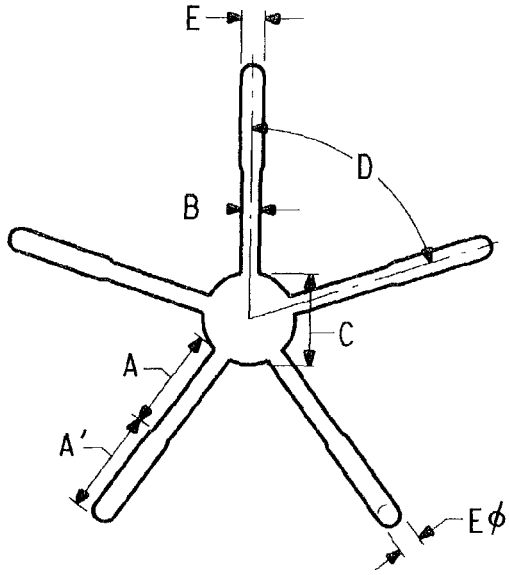
FIG. 16 shows a spinneret orifice used in the Examples to form five-winged multiple component fibers.

Bicomponent multi-winged filaments having a substantially round elastomeric core and 5 hard polymer wings arranged symmetrically about the core were spun using the pre-coalescence spinneret orifice geometry shown in the FIG. 16. The capillary dimensions shown in the figure are given in Table 1 below (E and Eϕ represent the diameters of a semicircle forming the wing tip).

TABLE 1

Spinneret Capillary Dimensions

| | Dimension |
|---|---|
| A | 0.015 in (0.038 cm) |
| A' | 0.020 in (0.051 cm) |
| B | 0.0035 in (0.0089 cm) |
| C | 0.012 in (0.30 cm) |
| D | 72 degrees |
| E, Eϕ | 0.0045 in (0.0114 cm) |

The elastomeric core polymer was Hytrel® 3078 copolyetherester resin (flexural modulus 28 MPa) available from DuPont. The "hard" polymer was a high density polyethylene (HDPE) resin available from Equistar Inc. (Cincinnati, Ohio) as H-5618 HDPE. The Hytrel® 3078 polymer was dried in a vacuum oven at a temperature of 105° C. to a moisture content of less than 50 ppm.

The two polymers were separately extruded and metered to a spin-pack assembly heated to 235° C. having 34 spin capillaries arranged in two concentric circles. A stack of distribution plates combined the two polymers in a core-winged configuration and fed the spinneret capillaries. The throughput per hole was 1.07 g/min. The Hytrel® 3078 polymer constituted 60% by weight of this throughput and the HDPE constituted 40% by weight.

The filament bundle exiting the spinneret was cooled by a cooling air quench in a cross-flow quench zone, approximately 2 meters long. The filaments were then fed to a set of two driven 8 inch (20.3 cm) diameter feed rolls. Ten filament wraps were applied on the feed rolls. The rolls were operated at a speed of 698 m/min and were maintained at a temperature of 30° C. The filaments were then fed to a set of two driven 8 inch (20.3 cm) diameter draw rolls. Ten wraps were applied on the draw rolls and the rolls were operated at a speed of 3000 m/min and a temperature of 30° C. The filaments exiting the draw rolls were collected on cardboard cores on a winder. The filament bundle of 34 filaments had a total denier of 110 (120 dtex).

Six bobbins, each wound with 110 denier (120 dtex), 34 filament yarn, were unwound together to form a 660 denier (720 dtex) tow. Due to the relatively low glass transition temperature of the HDPE wing polymer, the filaments developed a one-dimensional spiral twist configuration with substantially no three-dimensional crimp as they were unwound from the cores. The tow was fed to a Lummus Fiber Cutter (Model Mark III) which cut the tow to 1 inch (2.54 cm) lengths. The cutter settings were tuned in a standard way to minimize the number of tow breaks during the cutting operation. The fiber was not crimped during the cutting operation. No finish was applied to the fiber and no opening process steps were performed on the cut fiber. The cut fiber was collected in a bag.

The cut fiber was transferred to a Rando Webber laboratory airlay machine (model 40B). The feeder fan was run at 1700 rpm, the pressure fan was run at 2000 rpm, and the vacuum fan was run at 2000 rpm. The feed roll was run at 1.3 ft/min (0.4 m/min) to feed the fiber to the lickering roll running at 1700 rpm. The web was collected on the condensor screen running at 5 yards/min (4.6 m/min). Room humidity was controlled to 55% to minimize static electricity effects during the web forming operation. At these process conditions, a web of the fiber was formed having a basis weight of about 2 oz/yd$^2$ (68 g/m$^2$).

A section of the unconsolidated web was taken to a laboratory hydroentangling unit where the web was consolidated with water jets to form a nonwoven fabric. The web was entangled on both sides using a 100 mesh metal screen. On the first side the web was processed with 7 jets with a staged pressure profile from 200 to 2000 lb/in$^2$ (1378-13,780 kPa). On the second side the web was processed with 7 jets with a staged pressure profile from 200 to 1800 lb/in$^2$ (1378-12,400 kPa). Each water jet strip consisted of 0.005 inch (0.127 mm) holes in a linear array with a linear hole density of 40 holes/inch (15.7 holes/cm). The sample was air-dried and had a basis weight of 75 g/m$^2$ and a Frazier air permeability of 425 ft$^3$/min/ft$^2$ (129.5 m$^3$/min/m$^2$). The fabric demonstrated 90 percent instantaneous recovery after a 30% elongation by hand and substantially 100% recovery within 30 seconds. The same degree of recovery was observed in all fabric directions. The sample had a textile-like, soft hand that is characteristic of polyethylene-based nonwovens, i.e. there was no elastomeric rubber-like hand that would be typical of an elastomer-based nonwoven fabric.

Examples 2-5

A mono-filament bicomponent yarn having an elastomeric core and five wings symmetrically arranged about the core with core penetration into the wings (see FIG. 6) was spun using a five-wing version of the spinneret geometry shown in FIGS. 13, 13A, 13B, and 13D and the process shown in FIG. 12 without steam relaxation. The ratio $R_1/R_2$ (see FIG. 2) was between about 1.35 to 1.4.

The wing polymer was Camacari Nylon 6, VISCOSIDADE 3.14 IV available from DuPont Polimeros LTDA (Camacari, Brazil) having a reported relative viscosity of 55 and the core polymer was Pebax® 3533SN polyether block polyamide elastomer, supplied by Atofina Chemicals (Philadelphia, Pa.). The wing polymer contained 5% by weight of nylon 12 to promote cohesion to the core polymer. A 25 denier (28 dtex) per filament mono-filament was produced at a spinning speed of 420 meters per minute and a draw ratio of 3.5× and was wound up as a yarn package. A water-dispersed silicon finish was applied to the filament after drawing. The core portion comprised 60% by volume of the total monofilament cross section. The filament was observed to have 101% stretch after boil-off, 27.6% absolute shrinkage after boil-off, and 95% recovery after boil-off.

The filament was cut into either 3.0 inch (7.6 cm) or 1.5 inch (3.8 cm) lengths using standard cutting methods. No heat was applied to the filaments during the cutting process. The staple fibers were subjected to heat treatment in an autoclave to shrink the fibers and activate the spiral twist. Three pounds each of the bicomponent 3-inch (7.6 cm) length and 1.5-inch (3.8 cm) cut length staple fibers were placed in separate cloth bags, and subsequently the bagged fiber was placed in an autoclave and subjected to 240° F. (116° C.) pressurized steam for 20 minutes. The bagged fiber was then placed in a tumble dryer at 100° C. for 30 minutes. After processing the fiber was observed to have shrunk to close to half its original length, from either 3.0 inches (7.6 cm) to 1.3 inches (3.3 cm), or from 1.5 inches (3.8 cm) to 0.65 inches (1.7 cm) in length. The autoclaved fibers developed spiral twist as a result of the heat treatment, with the fiber wings observed to be spirally twisted about the fiber axis in alternating directions with intervening reversal nodes. The fibers had no significant degree of three-dimensional crimp, that is they required less than 6% stretch to straighten the fiber axis.

A point-bonded nonwoven sheet was formed by hand by sprinkling the autoclaved fiber substantially evenly over the surface of a patterned bonding plate suitable for placing in a Carver platen press. The plate was covered with Kapton® polyimide film to prevent melt sticking of the fibers to the plate. In Example 5, a 50/50 by weight blend of the 7.6 and 3.8 cm autoclaved staple fibers was used. The staple fiber blend was prepared by hand-dispersing the fibers together and shaking the mixture of fibers in a bag. The patterned point-bonding plate had a 9 percent bonding area with 0.05 inch×0.05 inch (1.3 mm×1.3 mm) square elevated bond points that were 0.015 inch (0.4 mm) high, 1296 count and a bond distance of 0.11 inch (2.8 mm). The patterned bonding plate having the staple fibers spread thereon was covered with a smooth plate, also covered with Kapton® polyimide film, placed in a Carver platen press, and bonded using the conditions summarized below in Table 2.

TABLE 2

Point Bonding Conditions

| Example | Bonding Temp. (° C.) | Pressure Lbs Force | Time (sec) | Basis Weight (oz/yd$^2$) | Autoclaved staple length (cm) |
|---|---|---|---|---|---|
| 2 | 125 | 500 (2.23 kN) | 120 | 6 (203 g/m$^2$) | 7.6 |
| 3 | 175 | 500 (2.23 kN) | 30 | 6 (203 g/m$^2$) | 3.8 |
| 4 | 150 | 500 (2.23 kN) | 30 | 8.2 (278 g/m$^2$) | 3.8 |
| 5 | 150 | 500 (2.23 kN) | 15 | 4.8 (163 g/m$^2$) | 7.6/3.8 (50/50) |

It was observed that thermal point-bonding of webs formed from bicomponent pre-shrunk staple in relaxed configuration is a means to high stretch nonwovens with dry hand. The five-winged bicomponent fiber was found to be self-bonding via its meltable core which can melt and flow forming spot bonds while fiber in between bond points retains its pre-bonding elastic character. Fiber-to-fiber bonding was sufficient to retain fabric integrity even while peeling the sample fabric from a Kapton® sheet to which it was well stuck after thermal bonding. Samples showed a dry, textile-like hand and good elastic stretch/recovery after pressing. Overbonding or high bond area was observed to create less drapeable, more film-like hand. The samples were observed to be thin and non-bulky and, as such, with optimization of dpf, cut length, and laydown construction, are potentially suitable for thin outerwear apparel fabrics.

Examples 6-7

These examples describe preparation of hand samples from bicomponent fibers comprising an elastomeric copolyetherester core and hard copolyetherester wings.

Bicomponent continuous filaments having a symmetrical six-wing cross-section substantially as shown in FIG. 2 were spun using an apparatus as illustrated in FIG. 12 from a pre-coalescence spinneret having 10 capillaries to form yarns having 10 filaments per yarn. The precoalescence spinneret pack was comprised of stacked plates shown as A through E in FIG. 13 with spinneret, distribution, and metering plates substantially as shown in FIGS. 13A-13C. The spinneret plate had ten orifices, each having six wings arranged symmetrically at 60 degrees, around a center of symmetry and were formed using a process as described in U.S. Pat. No. 5,168,143. As illustrated in FIG. 13A, each wing orifice was straight with a long axis centerline passing through the center of symmetry and had a length of 0.0233 inches from tip to the circumference of a central round spinneret hole 2 (diameter 0.008 inches) with origin of radius the same as the center of symmetry. There was no counterbore at the entrance to the spinneret capillary. The wing length from tip to 0.010 inches was 0.0035 inches wide; the remaining length of 0.0133 inches was 0.0024 inches wide. The tip of each wing was radius-cut at one-half the width of the tip.

The elastomeric core polymer was Hytrel® 3078 copolyetherester available from Dupont (flexural modulus 28 MPa) and the hard wing polymer was Hytrel® 7246 copolyetherester (flexural modulus 570 MPa), also available from DuPont. The fibers comprised 50 weight percent core polymer and 50 weight percent wing polymer. The polymers were extruded at 255° C. using the spinning conditions recorded in Table 3 below. After air quench, a spin finish was applied (DY-19 (K3053) from Gouston Technologies of Monroe, N.C. used at a concentration of 10%, at a rate of 1 cc/min). No steam treatment was performed after drawing the filaments.

TABLE 3

| Example | Draw Ratio | Denier Per Filament | Flow Rate (g/min/hole) | Feed Roll Speed (m/min) | Draw Roll Speed m/min |
|---|---|---|---|---|---|
| 6 | 4.2 | 5.4 | 0.54 | 380 | 1600 |
| 7 | 3.6 | 2.9 | 0.90 | 444 | 1600 |

The fibers were removed from the bobbins by slitting lengthwise down the bobbin and formed by hand into webs of alternating layers of fibers crossed at approximately 90 degrees. Two webs were formed from each of the yarn samples. The webs formed from the fibers of Example 6 had an average basis weight of about 5.9 oz/yd$^2$ and the webs formed from the fibers of Example 7 had an average basis weight of about 4.1 oz/yd$^2$. The webs were heated at 100° C. for 10 minutes prior to bonding to activate the spiral twist. The webs were thermally point bonded at a line speed of 5.2 meters/minute using a heated calendar roll. The bottom roll was a smooth metal roll and the top roll had a diamond pattern that produced about 34% bond area. Bond conditions are summarized in Table 4 below. The bonded fabrics were drapeable and had a soft, non-rubbery hand and good recoverable elongation, even when extended by 50%.

Recoverable elongation was measured by running the fabric through several programmed elongation cycles as described in the test methods above. The cumulative set is reported in Table 4 below. For example, to obtain the 25% value reported in Table 4, the sample has undergone 3 cycles at 15% (with a 30 second rest), and three cycles at 25% (with a 30 second rest). The value reported is the measurement at the end of the 25% cycles. The two samples prepared for each of Examples 6 and 7 were used to measure the cumulative set in two different directions—along the fiber axes (Examples 6a and 7a) and at 45 degrees to both fiber axes (Examples 6b and 7b).

TABLE 4

Nonwoven Fabric Set

| Example | Bond Temp (° C.) | Bond Pressure (lb/linear inch) | Cumulative set (%) after 3 cycles at: 15% | 25% | 50% |
|---|---|---|---|---|---|
| 6a | 155 | 400 | 2.1 | 2.4 | 6.3 |
| 6b | 155 | 400 | 4.6 | 4.6 | 7.0 |
| 7a | 175 | 1900 | 1.4 | 3.4 | 10.6 |
| 7b | 175 | 1900 | 1.3 | 2.6 | 8.4 |

Recovery power was measured as described above and reported in Table 5 below.

TABLE 5

Recovery Power

| Example | 3rd cycle load at 15% (force in pounds) | 3rd cycle unload at 15% (force in pounds) |
|---|---|---|
| 6a | 0.29 | 0.22 |
| 6b | 0.07 | 0.05 |
| 7a | 0.90 | 0.59 |
| 7b | 0.23 | 0.16 |

Example 8

Bicomponent multi-wing spunbond filaments having a round elastomeric core and five wings arranged symmetrically about the core were spun using the spinneret orifice geometry shown in the FIG. 16. The capillary dimensions are given in Table 1. The spinneret capillaries had a length of 0.025 inch (0.064 cm) and a counterbore diameter of 0.125 inch (0.318 cm). The spinneret used was rectangular in shape and had a total of 1020 capillaries (20 rows of 51 filaments in each row). The capillaries were arranged over a spacing of 504 mm×113 mm. The 20 rows of capillaries were arranged in a rectangular area 504 mm×113 mm on the face of the spinneret.

The elastomeric core polymer was Hytrel® 3078 copolyetherester resin (flexural modulus 28 MPa), available from DuPont. The "hard" wing polymer was Hytrel® 7246 copolyetherester resin (flexural modulus 570 MPa), also available from DuPont. The Hytrel® 3078 and Hytrel® 7246 polymers were dried in a vertical hopper drier at a temperature of 105° C. Both polymers had a moisture content of less than 50 ppm at the time of spinning.

The two polymers were separately extruded and metered to the spin-pack assembly having 1020 spin capillaries, described above. The spin-pack temperature was maintained at 265° C. A stack of distribution plates combined the two polymers in a core-wing configuration and fed the spinneret capillaries. The total polymer throughput per hole was 1.00 g/min. The Hytrel® 3078 core polymer constituted 60% by weight of this throughput and the Hytrel® 7246 polymer constituted 40% by weight of the total throughput.

Figure 17:
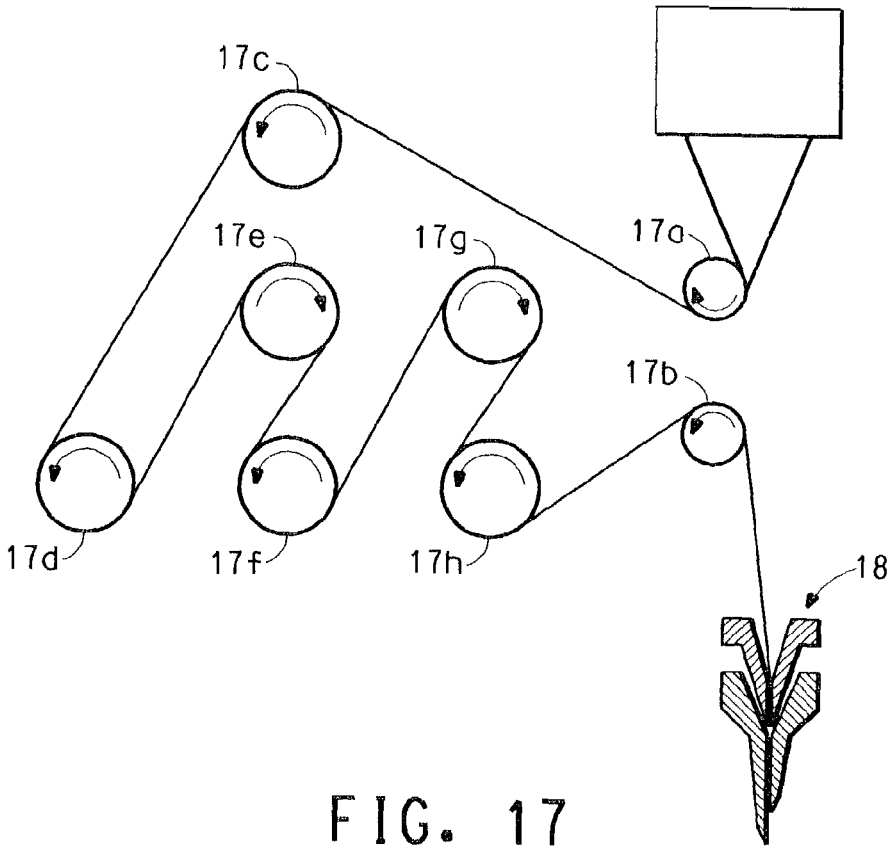
FIG. 17 is a schematic side view of spunbond apparatus used in making nonwoven fabrics of the current invention.

The filaments exiting the spinneret were cooled by a cooled air quench (12° C.) in an approximately 18.5 inches (47 cm) long co-current quench zone. The filament curtain was then drawn over a set of six draw rolls as shown in FIG. 17. Two change-of-direction rolls, 17*a* and 17*b*, were utilized to facilitate this. All of the rolls (six draw rolls and two change-of-direction rolls) were maintained at room temperature (approximately 26° C.). The two change-of-direction rolls had a surface diameter of 6.50". The six draw rolls had a surface diameter of 9.25 inches (23.5 cm). The surface speeds of the eight rolls were as follows:

| | |
|---|---|
| Change of Direction Roll 17a: | 450 m/min. |
| Draw Roll 17c: | 550 m/min. |
| Draw Roll 17d: | 700 m/min. |
| Draw Roll 17e: | 800 m/min. |
| Draw Roll 17f: | 1600 m/min. |
| Draw Roll 17g: | 1750 m/min. |
| Draw Roll 17h: | 1900 m/min. |
| Change of Direction Roll 17b: | 2050 m/min. |

The fibers exiting second change-of-direction roll 17*b* were fed to a slot aspirator jet 18 that extended the full width of the spinneret. The jet was fed with compressed air at a pressure of 40 psig. The filament curtain exiting the slot jet was collected on a moving wire belt. Vacuum was applied underneath the moving belt to facilitate pinning of the filaments to the belt. The filaments were collected on a polyester leader sheet and wound up on a winder as an unbonded roll. The belt speed was adjusted to yield a fabric with basis weight of 105 g/m$^2$.

The sample had a good, textile-like, soft hand that is characteristic of "hard" or semi-crystalline polymers; that is, the sample did not have the rubber like elastomeric feel.

Hand samples were cut from the center of the spunbond web and bonded off-line. Microscopic examination revealed that four of the wings were the hard Hytrel® polymer and the fifth one was the elastomeric Hytrel® polymer used to form the core. These samples were bonded at a line speed of 26 m/min on a point-bonding calendar roll using the conditions shown in Table 6 below. The calendar roll had a smooth metal bottom roll and a top roll with a crossbar pattern covering about 29% of the area.

Heat treatment activates the spiral twist in these fibers. Since the nonwoven samples were exposed to heat during the point-bonding process, this example was conducted in a way that compares the effect of heat applied at various points in the process. Webs were heated to 100° C. before bonding, not heated separately, or heated to 100° C. after bonding, as indicated in Table 6 below.

TABLE 6

Bonding Conditions

| | Treatment | Basis weight (oz/yd$^2$) | Bond temperature (° C.) | Bond pressure (pli) |
|---|---|---|---|---|
| Example 8A | Heat/bond | 7.6 | 165 | 400 |
| Example 8B | Bond only | 5.9 | 165 | 400 |
| Example 8C | Bond/heat | 6.8 | 165 | 400 |

It was found that all of the sample fabrics had relatively low levels of set after being stretched to 1.5 times their original length as shown in Table 7. While the sequence of heating had little effect on the set, a difference in elastic properties and recovery power was measured. This can be seen in Table 8 below, which compares the force needed to extend the sample (load) and the recovery force exerted by the sample as the elongation is decreased. In this table we compare the values measured during on the third cycle of the 25% elongation test. The force at 15% elongation on the way up to 25% elongation (load at 15%) and the force at 15% elongation on the way down to 0% elongation (unload at 15%) are reported.

TABLE 7

| Spunbond Fabric Set | | | | |
|---|---|---|---|---|
| | | Percent cumulative "set" after 3 cycles at: | | |
| | Treatment | 15% elongation | 25% elongation | 50% elongation |
| Example 8A | Heat/bond | 2.1 | 4.6 | 14.5 |
| Example 8B | Bond | 2.2 | 5.6 | 16.9 |
| Example 8C | Bond/heat | 1.8 | 4.3 | 14.4 |

TABLE 8

| Recovery Power | | | |
|---|---|---|---|
| | Treatment | $3^{rd}$ cycle load at 15% (force in pounds) | $3^{rd}$ cycle unload at 15% (force in pounds) |
| Example 8A | Heat/bond | 0.41 | 0.16 |
| Example 8B | Bond | 0.87 | 0.26 |
| Example 8C | Bond/heat | 0.76 | 0.30 |

It appears that the heat from the thermal point bonding process can be sufficient to create an elastic fabric. The application of heat before/after bonding and the bonding conditions itself (temperature, speed, pressure) can be optimized to provide a range of elastic properties, as desired for different applications.

What is claimed is:

1. A nonwoven web comprising synthetic multiple component fibers having a polymeric axial core, comprising a thermoplastic elastomeric polymer, and a plurality of polymeric wings attached to the core, the wings extending in a substantially spiral twist configuration along the length of the core and said wings comprising a polymer selected from the group consisting of a thermoplastic polymer having an elasticity that is less than the elasticity of the thermoplastic elastomer polymer of the core, a permanently drawable thermoplastic non-elastomeric polymer, and combinations thereof, wherein at least one of the wing polymer penetrates the core polymer, wherein the core has an outer radius $R_1$ and an inner radius $R_2$, and the ratio $R_1/R_2$ is greater than about 1.2;

wherein said at least one of the wing polymer penetrates the core polymer at a depth of the difference between the outer radius $R_1$ and the inner radius $R_2$;

wherein at least one of the core polymer penetrates the wing polymer;

wherein the core has another outer radius $R_1'$ and another inner radius $R_2'$, and the ratio $R_1'/R_2'$ is greater than about 1.2; and wherein said at least one of the core polymer penetrates the wing polymer at a depth of the difference between the outer radius $R_1'$ and the inner radius $R_2'$.

2. The nonwoven web according to claim 1 wherein the weight ratio of wing polymer to core polymer is in the range of about 10/90 to about 70/30.

3. The nonwoven web according to claim 2 wherein the multiple component fibers have a symmetric cross-section.

4. The nonwoven web according to claim 3 wherein the fibers have substantially one-dimensional spiral twist.

5. The nonwoven web according to claim 2 wherein the multiple component fibers have an asymmetric cross-section.

6. The nonwoven web according to claim 5 wherein the multiple component fibers have three-dimensional crimp.

7. The nonwoven web according to claim 1 wherein the non-elastomeric polymer is selected from the group consisting of polyamides, non-elastomeric polyolefins, and polyesters, and the elastomeric polymer is selected from the group consisting of polyurethanes, elastomeric polyolefins, polyesters, styrenic thermoplastic elastomers, and polyetheramides.

8. The nonwoven web according to claim 1 wherein the elastomeric polymer is selected from the group consisting of ethylene alpha-olefin copolymers, ethylene vinyl acetate copolymers, ethylene methyl acrylate copolymers, ethylene methyl acrylate acrylic acid terpolymers, ethylene acrylic acid copolymers, ethylene methacrylic acid copolymers, styrene/ethylene-butylene block copolymers, styrene-poly(ethylene-propylene)-styrene block copolymers, styrene-poly(ethylene-butylene)-styrene block copolymers, poly(styrene/ethylene-butylene/styrene) block copolymers, and styrene-poly(ethylene-propylene)-styrene-poly(ethylene-propylene) block copolymers.

9. The nonwoven web according to claim 7 wherein the non-elastomeric polymer is selected from the group consisting of a) poly(hexamethylene adipamide) and copolymers thereof with 2-methylpentamethylene diamine and b) polycaprolactam, and the elastomeric polymer is a polyetheramide.

10. The nonwoven web according to claim 7 wherein the non-elastomeric polymer is a non-elastomeric polyester and the elastomeric polymer is an elastomeric polyester.

11. The nonwoven web according to claim 10 wherein the non-elastomeric polyester is a non-elastomeric polyetherester and the elastomeric polyester is an elastomeric polyetherester.

12. The nonwoven web according to claim 10 wherein the non-elastomeric polyester is selected from the group consisting of poly(ethylene terephthalate), poly(trimethylene terephthalate), and poly(1,4-butylene terephthalate), and copolymers thereof, and the elastomeric polymer is an elastomeric polyetherester.

13. The nonwoven web according to claim 7 wherein the non-elastomeric polymer is a non-elastomeric polyolefin and the elastomeric polymer is an elastomeric polyolefin.

14. The nonwoven web according to claim 7 wherein the non-elastomeric polymer is a non-elastomeric polyolefin and the elastomeric polymer is a polyurethane.

15. The nonwoven web according to claim 5 wherein the wings are separated by unequal angles.

16. The nonwoven web according to claim 5 wherein at least one of the wings comprises a different polymer than at least one other wing.

17. The nonwoven web according to claim 5 wherein at least one of the wings comprise an elastomeric polymer.

18. The nonwoven web according to claim 3 wherein at least two of the wings comprise an elastomeric polymer.

19. The nonwoven web according to claim 17 wherein the elastomeric polymer in the at least one wing comprises at least a portion of the surface of the wing.

20. The nonwoven web according to claim 18 wherein the elastomeric polymer in the at least two wings comprises at least a portion of the surface of the at least two wings.

21. The nonwoven web according to claim 5 wherein at least one of the wings has a different shape than at least one other wing.

22. The nonwoven web according to claim 1 wherein the core includes on its surface a sheath of a non-elastomeric polymer between points where the wings contact the core.

23. The nonwoven web according to claim 1 wherein each of the wings is mechanically locked to the core.

24. The nonwoven web according to claim 1 further comprising secondary fibers.

25. The nonwoven web according to claim 24 wherein the secondary fibers are single component fibers.

26. The nonwoven web according to claim 25 wherein the secondary fibers are selected from the group consisting of polyester fibers and polyolefin fibers.

27. The nonwoven web according to claim 1 wherein the multiple component fibers are continuous filaments.

28. The nonwoven web according to claim 27 wherein the multiple component fibers are spunbond filaments.

29. The nonwoven web according to claim 1 wherein the multiple component fibers are staple fibers.

30. The nonwoven web according to claim 1 wherein the elastomeric core polymer has a flexural modulus of less than about 96,500 kPa.

31. The nonwoven web according to claim 30 wherein the elastomeric core polymer has a flexural modulus of less than about 58,600 kPa.

32. The nonwoven web according to claim 1 wherein the elastomeric core polymer has a flexural modulus of less than about 58,600 kPa and at least one of the wings comprises an elastomeric polymer having a flexural modulus of at least 58,600 kPa.

33. The nonwoven web according to claim 32 wherein at least one of the wings comprises an elastomeric polymer having a flexural modulus between 58,600 kPa and about 96,500 kPa.

34. The nonwoven web according to claim 33 wherein at least one of the wings comprises an elastomeric polymer having a flexural modulus between about 82,700 kPa and 96,500 kPa.

35. The nonwoven web according to claim 25 wherein the single component fibers consist essentially of a nonelastomeric polymer.

36. The nonwoven web according to claim 1 wherein the nonwoven web is a bonded web.

37. The bonded nonwoven web according to claim 36 wherein the web is bonded by a method selected from the group consisting of thermal point bonding, ultrasonic bonding, through air bonding, resin bonding, hydraulic needling, and mechanical needling.

38. The nonwoven web according to claim 1 wherein the spiral twist is substantially circumferential.

39. The nonwoven web according to claim 1 wherein the spiral twist is substantially non-circumferential.

40. The nonwoven web according to claim 1 wherein the axial core has a cross-sectional shape selected from the group consisting of substantially round, oval, and polyhedral.

41. The nonwoven web according to claim 40 wherein the axial core is substantially round.

42. The nonwoven web according to claim 40 wherein the axial core is substantially polyhedral.

* * * * *